US007980215B2

(12) United States Patent
Tashiro

(10) Patent No.: US 7,980,215 B2
(45) Date of Patent: Jul. 19, 2011

(54) VALVE SYSTEM FOR INTERNAL COMBUSTION ENGINE

(75) Inventor: Masahiko Tashiro, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 239 days.

(21) Appl. No.: 12/457,358

(22) Filed: Jun. 9, 2009

(65) Prior Publication Data

US 2009/0266321 A1 Oct. 29, 2009

Related U.S. Application Data

(63) Continuation of application No. 11/780,162, filed on Jul. 19, 2007, now Pat. No. 7,631,622.

(30) Foreign Application Priority Data

Jul. 19, 2006 (JP) ..... P. 2006-197134

(51) Int. Cl.
*F01L 1/18* (2006.01)

(52) U.S. Cl. ..... 123/90.39; 123/90.16; 123/90.44; 74/559; 74/569

(58) Field of Classification Search ..... 123/90.16, 123/90.39, 90.44, 90.6; 74/559, 567, 569
See application file for complete search history.

(56) References Cited

U.S. PATENT DOCUMENTS

| | | | |
|---|---|---|---|
| 6,988,473 | B2 | 1/2006 | Rohe et al. |
| 7,556,003 | B2 * | 7/2009 | Fujii et al. ..... 123/90.39 |
| 2004/0094107 | A1 | 5/2004 | Nakano et al. |

FOREIGN PATENT DOCUMENTS

| | | | |
|---|---|---|---|
| DE | 10 2004 06186 | A1 | 8/2006 |
| EP | 1 754 865 | A2 | 2/2007 |
| EP | 1 826 367 | A1 | 8/2007 |
| JP | 7064199 | A | 3/1995 |
| JP | 10325310 | A | 12/1998 |
| JP | 2005226636 | A | 8/2005 |
| JP | 2005-315182 | A | 11/2005 |
| JP | 2005315182 | A | 11/2005 |
| JP | 2005351190 | A | 12/2005 |
| WO | WO 2004/059133 | A1 | 7/2004 |

OTHER PUBLICATIONS

Office Action dated Jan. 29, 2010 of the corresponding Japanese application No. 2006-197134.
European Search Report dated Nov. 13, 2007 issued in European Application No. 07014216.1.

* cited by examiner

*Primary Examiner* — Ching Chang
(74) *Attorney, Agent, or Firm* — Westerman, Hattori, Daniels & Adrian, LLP

(57) ABSTRACT

A variable valve system includes a transmission mechanism T which transmits a valve actuating force to an inlet valve 11 and which varies a maximum lift amount of the inlet valve 11 and biasing members 60. A sub-cam 40 oscillatably supported on a holder 30 driven by a control member 70 has a roller 43 contacting the inlet cam 15*a*, a drive cam portion 46 outputting the valve actuating force, and acting portions A contacting the biasing members 60. The acting portions A are provided in the vicinity of the roller 43 so that biased contact points 45*a*1, 45*b*1 are positioned nearer to a cam contact point 43*a* than an oscillation center line Ls and that an acting line L1 of a biasing force is superposed on the roller 43 as viewed in the direction of the oscillation center line Ls.

25 Claims, 9 Drawing Sheets

VALVE SYSTEM FOR INTERNAL COMBUSTION ENGINE

REFERENCE TO RELATED APPLICATIONS

This application is a continuation application of U.S. Ser. No. 11/780,162, filed Jul. 19, 2007, and is based upon and claims the benefit of priority from the prior Japanese Patent Application No. 2006-197134, filed Jul. 19, 2006, the entire contents of which is incorporated by reference.

BACKGROUND OF THE INVENTION

1. Field of the Invention

The present invention relates to a variable valve system which can change a maximum lift amount of at least either of an inlet valve and an exhaust valve which are engine valves in an internal combustion engine.

2. Description of Related Art

There has been known a variable valve system for an internal combustion engine which includes a transmission mechanism for transmitting a valve actuating force of a valve cam to an engine valve and changing a maximum lift amount of the engine valve by being actuated by a control member and a biasing member for generating a biasing force which brings a rocker member which makes up the transmission mechanism into contact with the valve cam (for example, refer to Japanese Patent Unexamined Publication JP-A-2005-315182). In the variable valve system, the rocker member is supported on a holder, which is driven to be displaced by the control member, in such a manner as to oscillate thereon, and the biasing member applies biasing force to an acting portion of the rocker member so as to bring a cam contact portion of the rocker member into contact with the valve cam.

[First Problem]

In the rocker member which makes up the transmission mechanism of the variable valve system, in the event that a cam contact point of the cam contact portion with the valve cam is spaced away from a biased contact point of the acting portion with the biasing member due to, for example, the cam contact portion and the acting portion being provided in opposite positions across an oscillation center line, this causes not only the enlargement in size but also the reduction in rigidity of the rocker member. Then, when the rigidity of the rocker member is reduced, since the rocker member is made easy to be deformed by virtue of the biasing force of the biasing member, the following capability of the rocker member to the valve cam is reduced, whereby the opening and closing accuracy of the engine valve is reduced. Then, to cope with this, when attempting to increase the rigidity of the rocker member by increasing the thickness thereof, the rocker member has to be enlarged, and the weight thereof also has to be increased, thereby an enlargement in size and an increase in weight of the transmission mechanism having to be called for. In addition, when attempting to increase the biasing force of the biasing member so as to prevent the reduction in following capability of the rocker member which is attributed to an increase in inertial mass thereof, power is increased which is necessary to actuate the valve cam against the biasing force applied to the valve cam via the rocker member, this resulting in deterioration in fuel economy.

Further, there have been known a variable valve system for an internal combustion engine which includes a transmission mechanism for transmitting a valve actuating force of a valve cam to an engine valve and changing a maximum lift amount of the engine valve by being actuated by a control member and a biasing member for generating a biasing force which brings the transmission mechanism into contact with the valve cam, wherein the transmission mechanism is made up of a sub-cam having a cam contact portion which contacts the valve cam, a rocker arm which pressurizes the engine valve and which is driven by the sub-cam and a holder which supports the sub-cam and the rocker arm in such a manner as to oscillate thereon (refer to the JP-A-2005-315182).

[Second Problem]

In a sub-cam which makes up a transmission mechanism of a variable valve system, in the event that a fulcrum portion which is supported on a holder in such a manner as to oscillate thereon is disposed between a cam contact portion with which a valve cam is brought into contact and an acting portion with which a biasing member is brought into contact, a distance extending from the acting portion to an input portion across the fulcrum portion becomes long, and because of this, the sub-cam is enlarged in size and the rigidity of the sub-cam is reduced. In addition, in the event that the rigidity of the sub-cam is reduced, since the sub-cam tends to be easily deformed by virtue of the biasing force of the biasing member, the following capability of the sub-cam to the valve cam is reduced, whereby the opening and closing control accuracy of the engine valve is reduced. Then, when attempting to enhance the rigidity of the sub-cam by increasing the thickness thereof, the sub-cam is enlarged in size, and this calls for increase in size and weight of the transmission mechanism. In addition, when attempting to increase the biasing force of the biasing member in order to prevent the reduction in following capability which is attributed to an increase in inertial mass of the sub-cam, power is increased which is necessary to drive the valve cam against the biasing force which is applied to the valve cam through the sub-cam, and the fuel economy is deteriorated.

Furthermore, in the event that the biasing member is held on to the holder, when the biasing member protrudes from the transmission mechanism, the variable valve system is made larger in size by such an extent that the biasing member protrudes from the transmission mechanism.

Furthermore, there has been known a variable valve system for an internal combustion engine which includes a transmission mechanism for transmitting a valve actuating force of a valve cam to an engine valve and changing a maximum lift amount of the engine valve by being driven by a control member, wherein the transmission mechanism is made up of a sub-cam which contacts the valve cam, a rocker arm which pressurizes the engine valve and which is driven by the sub-cam and a holder which supports the sub-cam and the rocker arm in such a manner as to oscillate thereon and which is driven by the control member (refer to the JP-A-2005-315182).

[Third Problem]

In the event that a holder which makes up a transmission mechanism of a variable valve mechanism supports a rocker arm in such a manner as to oscillate thereon and a control force from a control member is applied to the holder, since the control force is applied to the holder through the rocker arm in addition to a valve actuating force from a valve cam and a reaction force from an engine valve, in order to enhance the control accuracy of opening and closing control of the engine valve which includes control of maximum lift amount, the rigidity of the holder needs to be enhanced so as to suppress the generation of deformation of the holder due to the loads. However, attempting to enhance the rigidity of the holder calls for an increase in size and weight of the holder.

SUMMARY OF THE INVENTION

The invention has been made in view of the first problem, and one object thereof is to provide, in its first to fourth aspects, a variable valve system for an internal combustion engine which can realize the reduction in size and weight of the rocker member, as well as the improvement in following capability of the rocker member by devising the contact position of the biasing member with the rocker member which makes up the transmission mechanism.

In addition, another object of the invention is to realize, in its second and third aspects, the reduction in size of the rocker member with respect to the size in a direction of its oscillation center line, as well as the increase in durability of the acting portion.

Furthermore, a further object of the invention is to increase, in its third aspect, the lubricating capability of the support shaft.

Moreover, an object of the invention is to increase, in its fourth aspect, the dislocation preventing effect of the snap ring, which restricts the movement of the support shaft, from the arm portion by making use of the acting portion with which the rocker member is brought into contact.

Further, the invention has been made in view of the second problem, and another object of the invention is to provide, in its first to fourth aspects, a variable valve system for an internal combustion engine which can realize the reduction in size and weight of a sub-cam which makes up a transmission mechanism and the increase in following capability of the sub-cam to a valve cam by devising the arrangement of biasing members relative to the sub-cam.

In addition, another object of the invention is to realize, in its second aspect, the reduction in size of the variable valve system by devising the arrangement of the transmission mechanism and the biasing members.

Furthermore, a further object of the invention is to realize, in its third and fourth aspects, the increase in lubricating property of the biasing member by providing an oil passage in the transmission mechanism.

Furthermore, the invention has been made in view of the third problem, and still another object thereof is to provide, in its first to seventh aspects, a variable valve system for an internal combustion engine which can realize the increase in opening and closing control accuracy of an engine valve while suppressing the increase in size and weight of a holder by devising the position or arrangement of an acting point of a control force which is applied to the holder by a control member.

In addition, another object of the invention is to realize, in its third aspect, the increase in following capability of a first contact portion to a control shaft.

Also, a further object of the invention is to realize, in its fourth aspect, the reduction in the number of components by devising the arrangement of a contact portion to which the control force is applied by the control member.

Furthermore, an object of the invention is to realize, in its fifth aspect, the miniaturization of the variable valve system by devising the arrangement of the contact portion to which the control force is applied by the control member.

Still further, another object of the invention is to enhance, in its sixth aspect, the transmission efficiency of the control force which is applied by the control member.

According to a first aspect of the invention, there is provided a variable valve system for an internal combustion engine including:

a valve cam which actuates an engine valve of the internal combustion engine;

a transmission mechanism which transmits a valve actuating force of the valve cam to the engine valve and changing a maximum lift amount of the engine valve by being driven by a control member; and a biasing member which generates a biasing force which brings the transmission mechanism into contact with the valve cam, wherein the transmission mechanism includes:

a holder actuated by the control member; and a rocker member oscillatably supported on the holder, the rocker member includes:

a cam contact portion which contacts with the valve cam at a cam contact point, an output portion which outputs the actuating force, which is inputted from the valve cam into the cam contact portion, to the engine valve, and an acting portion which contacts with the biasing member at a biased contact portion, wherein the acting portion is provided in the vicinity of the cam contact portion in such a manner that:

the biased contact point is situated closer to the cam contact point than a rocking center line of the rocker member and an acting line of the basing force is superposed on the cam contact portion as viewed from a direction of the rocking center line.

According to a second aspect of the invention, it is adaptable that the cam contact portion is a roller which is provided on a support shaft which is provided on an arm portion of the rocker member, and the acting portion is a cylindrical shaft end portion of the support shaft which protrudes to an opposite end to the roller across the arm portion.

According to a third aspect of the invention, it is adaptable that the cam contact portion is a roller which is provided on a support shaft which provided rotatably on an arm portion of the rocker member, the acting portion is a protruding portion which protrudes from the shaft portion at an opposite end to the roller across the arm portion and the protruding portion forms an oil reservoir portion for reserving lubricating oil for supply to a sliding portion between the arm portion and the support shaft.

According to a fourth aspect of the invention, it is adaptable that an axial movement of the support shaft is restricted by a snap ring which is mounted in a mount groove in the arm portion and the protruding portion is molded integrally with the arm portion where the mount groove is provided.

According to a fifth aspect of the invention, there is provided a variable valve system for an internal combustion engine including:

a valve cam for actuating an engine valve of the internal combustion engine;

a transmission mechanism for transmitting a valve actuating force of the valve cam to the engine valve and changing a maximum lift amount of the engine valve by being driven by a control member; and a biasing member for generating a biasing force which brings the transmission mechanism into contact with the valve cam, wherein the transmission mechanism includes:

a sub-cam which is biased by the biasing member;

a rocker arm which pressurizes the engine valve and which is driven by the sub-cam; and a holder which oscillatably supports the sub-cam and the rocker arm and which is driven by the control member, the sub-cam has a fulcrum portion which is oscillatably provided on the holder, a cam contact portion which contacts the valve cam at a cam contact point, a drive cam portion which contacts the rocker arm and an acting portion which contacts the biasing member at a biased contact point, the holder has:

a pair of arm portions which support the sub-cam and which are spaced apart in a direction of an oscillation center line of the sub-cam and a connecting portion which connects together the pair of arm portions, and the biasing member is disposed on both sides of the cam contact portion in the direction of the oscillation center line and is held on to the connecting portion.

According to a sixth aspect of the invention, it is adaptable that the biasing member is disposed in a position where the biasing member is superposed on the drive cam portion in a direction of an acting line of a biasing force.

According to seventh and eighth aspects of the invention, it is adaptable that the rocker arm includes:

a hydraulic clearance adjusting member for adjusting a valve clearance of the engine valve; and an accommodating portion which accommodates therein the clearance adjusting member and which defines, in cooperation with the clearance adjusting member, an oil chamber, and an air vent hole for discharging air within the oil chamber is provided in the accommodating portion in such a manner as to be directed towards the biasing member.

According to ninth through twelfth aspects of the invention, it is adaptable that the rocker arm includes a fulcrum portion which is oscillatably supported on the holder, a straight-line oil passage is provided in the rocker arm which has an injection opening from which lubricating oil can be injected towards the biasing member in an end portion and extends towards the fulcrum portion, and the biasing member is disposed on an extension of the oil passage.

According to a thirteenth aspect of the invention, there is provided a variable valve system for an internal combustion engine including:

a valve cam for actuating an engine valve of the internal combustion engine; and a transmission mechanism for transmitting a valve actuating force of the valve cam to the engine valve and changing a maximum lift amount of the engine valve by being driven by a control member, wherein the transmission mechanism includes:

a sub-cam which contacts the valve cam, a rocker arm which pressurizes the engine valve and which is driven by the sub-cam, and a holder which is supported on an engine main body in such a manner as to be displaced about a displacement center line and which oscillatably supports the sub-cam and the rocker arm, the rocker arm is oscillatably supported on an arm portion of the holder, a distance between an acting point of a control force which is applied to the holder by the control member, and an oscillation center line of the rocker arm is made shorter than a distance between the displacement center line and the oscillation center line.

According to a fourteenth aspect of the invention, there is provided a variable valve system for an internal combustion engine including:

a valve cam for actuating an engine valve of the internal combustion engine; and a transmission mechanism for transmitting a valve actuating force of the valve cam to the engine valve and changing a maximum lift amount of the engine valve by being driven by a control member, wherein the transmission mechanism including:

a sub-cam which contacts the valve cam;

a rocker arm which pressurizes the engine valve and which is driven by the sub-cam; and a holder which is supported on an engine main body in such a manner as to be displaced about a displacement center line and which oscillatably supports the sub-cam and the rocker arm the rocker arm is oscillatably supported on a support portion of the holder, and an acting line of a control force applied to the holder by the control member is superposed on the support portion as viewed from a direction of an oscillation center line of the rocker arm.

According to fifteenth and sixteenth aspects of the invention, it is adaptable that the control member includes:

a control shaft which contacts a first contact portion of the holder so as to apply a driving force thereto; and a controlling biasing member which contacts a second contact portion of the holder and which produces a controlling biasing force for biasing the first contact portion relative to the control shaft, and the controlling biasing member contacts the second contact portion in the vicinity of the oscillation center line.

According to seventeenth and eighteenth aspects of the invention, it is adaptable that the support portion is a support shaft provided on the holder, and the first contact portion is a roller which is rotatably supported on the support shaft.

According to a nineteenth aspect of the invention, it is adaptable that the rocker arm includes:

a plurality of valve pressurizing portions which pressurize a plurality of engine valves; and a pair of fulcrum portions which define an accommodation space which accommodates therein the first contact portion and which are disposed on both sides of the roller with the roller held therebetween in a direction in which the plurality of valve pressurizing portions are aligned.

According to twentieth and twenty-first aspects of the invention, it is adaptable that a drive cam of the control shaft which contacts the first contact portion, the controlling biasing member and the first contact portion are disposed in positions which intersect a plane which is parallel to a cylinder axis of the internal combustion engine and a rotational center line of the valve cam.

According to a twenty-second aspect of the invention, it is adaptable that the holder includes a pair of arm portions on which the support portion is provided, and the controlling biasing member contacts a connecting portion which connects together the pair arm portions in the vicinity of the support portion.

According to the first aspect of the invention, in the rocker member of the transmission mechanism, since the acting portion with which the basing member for bringing the cam contact portion into contact with the valve cam is brought into contact is provided in the vicinity of the cam contact portion, or more specifically, since the cam contact portion is positioned in such a manner as to be superposed on the acting line of the biasing force at the biased contact point, so as to reduce a distance between the cam contact point and the biased contact point, the rocker member is made smaller in size and lighter in weight, and as result of the deformation of the rocker member between the cam contact point and the biased contact point being suppressed, the following capability of the rocker member to the valve cam is increased to thereby increase the opening and closing control accuracy of the engine valve.

According to the second aspect of the invention, since the acting portion can easily be provided at the cam contact portion which lies in the vicinity of the roller and the shaft end portion is situated at the opposite end to the end where the roller is provided across the arm portion, the arm portion can be made to come nearer to the roller in the direction of the oscillation center line, whereby the arm portion can be made smaller in size in the direction of the oscillation center line, and hence, the rocker member is made lighter in weight.

According to the third aspect of the invention, since the acting portion can easily be provided at the cam contact portion which lies in the vicinity of the roller and the protruding portion is situated at the opposite end to the end where the roller is provided across the arm portion, the arm portion can be made to come nearer to the roller in the direction of the oscillation center line, whereby the arm portion can be made smaller in size in the direction of the oscillation center line, and hence, the rocker member is made lighter in weight. Furthermore, since the lubricating oil which is reserved in the oil reservoir portion formed by the protruding portion is supplied to the sliding portion between the arm portion and the support shaft portion, the lubricating capability of the support shaft is increased. In addition, since the protruding portion can be made use of as a guiding portion for the support shaft when the support shaft is assembled on to the arm portion, the assembling property of the support shaft is increased.

According to the fourth aspect of the invention, since the rigidity of the arm portion on which the mount groove for the snap ring is provided is increased by the protruding portion, the deformation of the arm portion is suppressed which would otherwise be caused by the valve actuating force applied to the arm portion through the roller and the support shaft, the dislocation preventing effect of the snap ring from the arm portion is increased by making use of the acting portion with which the biasing member is brought into contact.

According to the fifth aspect of the invention, in the sub-cam of the transmission mechanism, since the biasing member is disposed on both the sides with the cam contact portion held therebetween, the biased contact point of the acting portion can be disposed near to the cam contact point of the cam contact portion, the sub-cam is made smaller in size and lighter in weight. Moreover, as a result of the deformation of the sub-cam between the cam contact point and the biased contact point being suppressed, the following capability of the sub-cam to the valve cam is increased, and hence, the opening and closing control accuracy of the inlet valve is increased. In addition, since the biasing member is disposed in such a manner as to hold the cam contact portion therebetween, the cam contact portion can be brought into contact with the valve cam in a stable state, and each biasing member is held on to the connecting portion whose rigidity is enhanced, these contributing to the enhancement of opening and closing control accuracy of the engine valve.

According to the sixth aspect of the invention, since the biasing member is disposed by making use of the space defined within the transmission mechanism for the drive cam portion of the sub-cam to be disposed therein, the variable valve system can be made smaller in size.

According to the seventh and eighth aspects of the invention, since the lubricating oil can be supplied to the biasing member by making use of the air vent hole formed in the oil chamber of the clearance adjusting member, the lubricating property of the biasing member can be increased by making use of the rocker arm of the transmission mechanism without forming separately an oil passage for supplying lubricating oil to the biasing member.

According to the ninth through twelfth aspects of the invention, since the lubricating oil is supplied to the biasing member through the oil passage formed in the rocker arm, the lubricating property of the biasing member can be increased by the oil passage provided by making use of the rocker arm of the transmission mechanism, and since the straight-line oil passage can be formed through a single drilling operation, the formation of the oil passage is facilitated.

According to the thirteenth aspect of the invention, since the control force of the control member is applied to the holder in the position which lies near to the oscillation center line where the rigidity is enhanced in order to support the rocker arm, the deformation of the holder due to loads such as the control force and the valve actuating force is suppressed while suppressing the increase in size and weight of the holder, and the shift response of the holder driven by the control member is increased, the opening and closing control accuracy of the engine valve being thereby increased.

According to the fourteenth aspect of the invention, since the control force of the control member is applied to the holder in the position which lies near to the oscillation center line where the rigidity is enhanced, the same advantage as that provided by the first aspect of the invention can be provided.

According to the fifteenth and sixteenth aspects of the invention, since the controlling biasing member contacts the second contact portion of the holder in the vicinity of the support portion, the deformation of the holder is suppressed which would otherwise be caused by the controlling biasing force, whereby the following capability of the first contact portion to the control shaft is increased, this contributing to the increase in opening and closing control accuracy of the engine valve.

According to the seventeenth and eighteenth aspects of the invention, since the roller to which the driving force is applied is supported by making use of the support shaft which supports the rocker arm, the number of components is reduced, and hence, the production costs are reduced.

According to the nineteenth aspect of the invention, since the rocker arm having the plurality of valve pressurizing portions is supported on the support shaft at the pair of fulcrum portions, the inclination of the rocker arm is prevented, and hence, the rocker arm is supported in a stable state, and since the roller is disposed in the accommodation space defined between the pair of fulcrum portions, the variable valve system can be miniaturized.

According to the twentieth and twenty-first aspects of the invention, since the drive cam, the first contact portion and the controlling biasing member are disposed to be aligned on the plane, the deformation of the holder due to the control force is suppressed, whereby the transmission efficiency of the control force to the holder is enhanced, and furthermore, the following capability of the roller to the control cam based on the controlling biasing force is also enhanced, the opening and closing control accuracy of the engine valve being thereby enhanced.

According to the twenty-second aspect of the invention, since the controlling biasing force is applied to the connecting portion whose rigidity is increased so as to increase the rigidity of the holder, this contributes to the enhancement in opening and closing control accuracy of the engine valve.

DETAILED DESCRIPTION OF EXEMPLARY EMBODIMENTS OF THE INVENTION EMBODIMENTS

Hereinafter, an embodiment of the invention will be described by reference to FIGS. 1 to 9.

Figure 1:
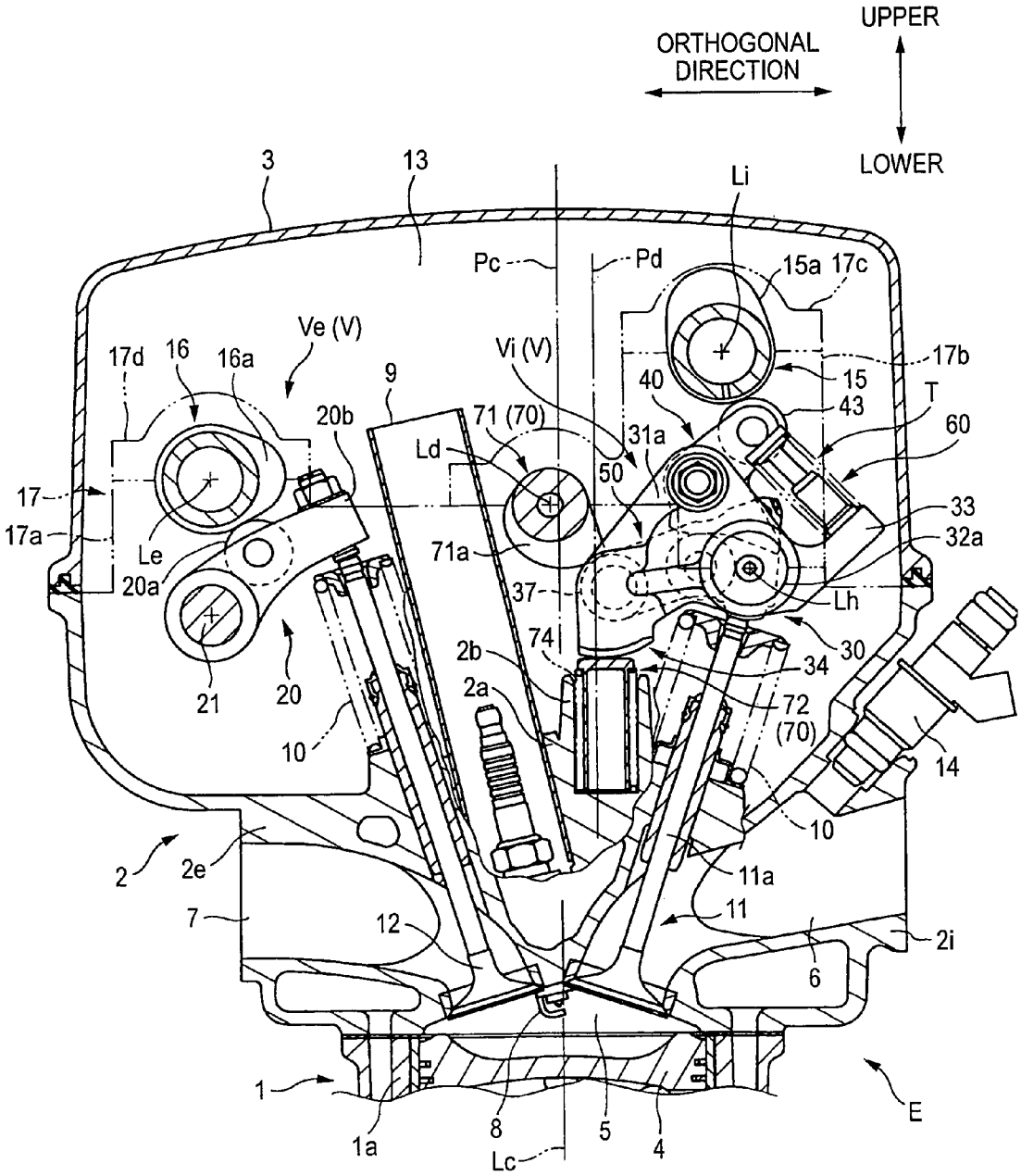
FIG. 1 is a sectional view showing a main part of an internal combustion engine provided with a variable valve system to which the invention is applied, which constitutes a schematic sectional view taken along the line I-I in FIG. 2 with respect to a cylinder head and a partial side view with respect to a valve system.
Figure 2:
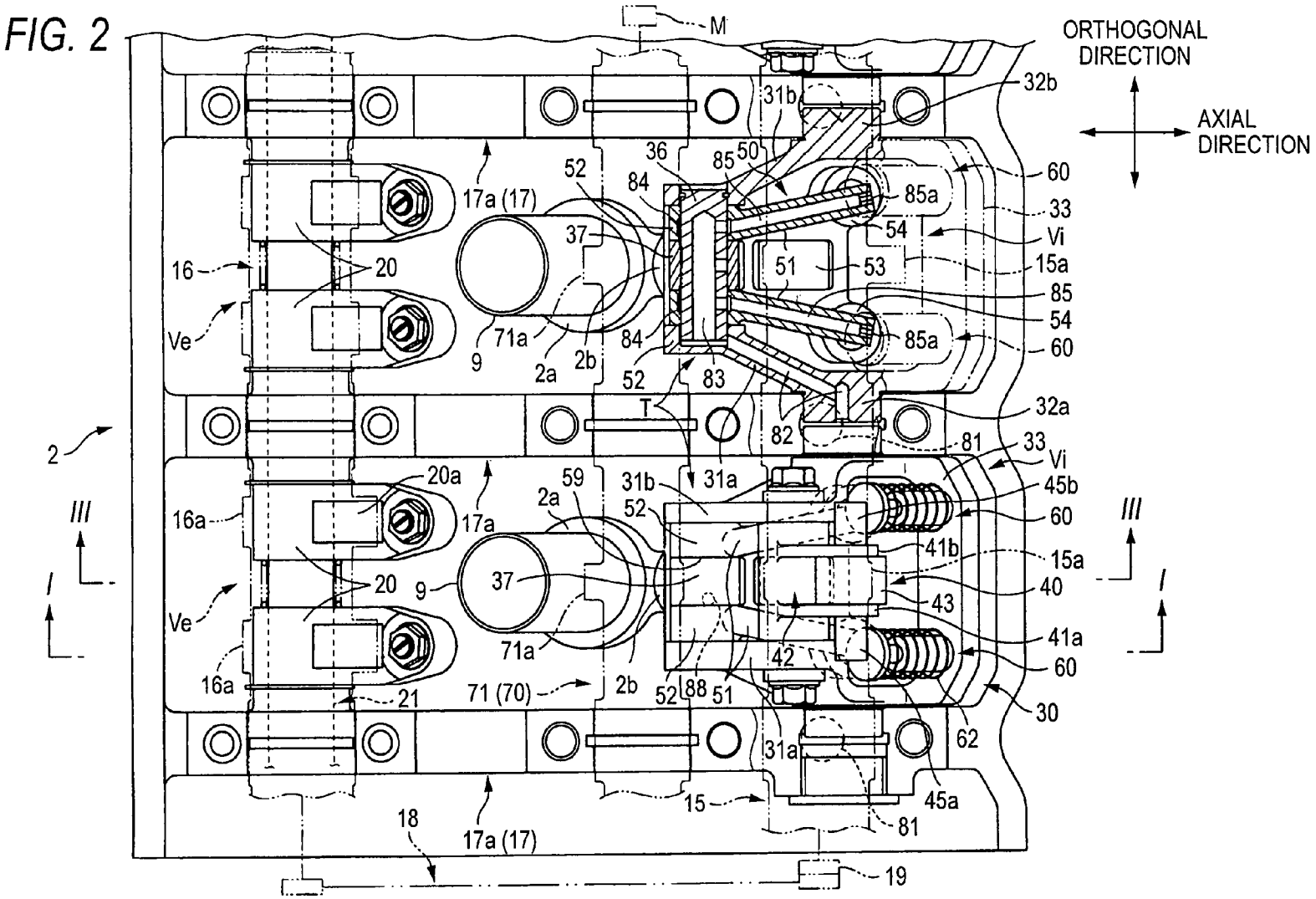
FIG. 2 is a plan view showing the main part of the internal combustion engine shown in FIG. 1 with a valve cover thereof removed, which shows part of a variable valve system in section.

Referring to FIGS. 1, 2, a variable valve system to which the invention is applied (hereinafter, referred to as a "variable valve system") is provided in an overhead camshaft type valve system V, and the valve system V is provided on a multi-cylinder, four-stroke internal combustion engine E which mounted on a vehicle transversely in such a manner that a crankshaft extends in a transverse direction of the vehicle. The internal combustion engine E includes an engine main body which is made up of a cylinder block 1 in which a plurality of, four in this embodiment, cylinders 1*a* are integrally formed in such a manner as to be aligned in series in a direction in which the cylinders 1*a* are to be aligned, a cylinder head 2 which is joined on to an upper end portion of the cylinder block 1, and a valve cover 3 which is joined on to an upper end portion of the cylinder head 2.

Note that when used in this specification, a vertical direction coincides with a vertical direction of the cylinder 1*a*, unless mentioned otherwise.

A piston 4, which is connected to the crankshaft via a connecting rod, is fitted in each cylinder 1*a* in such a manner as to reciprocate thereon. In the cylinder head 2, combustion chambers 5 are formed in the axial direction of the cylinders 1*a* in portions which face the pistons 4, respectively, in such a manner as to correspond to the respective cylinders 1*a*, and furthermore, inlet ports 6 which each have a pair of inlet openings and exhaust ports 7 which each have a pair of exhaust openings are also formed. Ignition plugs 8, which face the combustion chambers 5, respectively, are inserted into accommodation tubes 9, respectively, which are held by cylindrical holding portions 2*a* which are molded integrally on the cylinder head 2 together with ignition coils which are connected to the ignition plugs 8, so that the ignition plugs 8 are mounted on the cylinder head 2.

Inlet 11 and exhaust valves 12, which are both engine valves made up of tappet valves which are normally biased in a closed direction by means of valve springs 10, are provided on the cylinder head 2 in such a manner as to reciprocate. A pair of inlet 11 and a pair of exhaust valves 12 are provided for each cylinder 1*a* (or for each combustion chamber 5) in such a manner as to be actuated to be opened and closed by the valve system V, so as to open and close the pair of inlet openings and the pair of exhaust openings, respectively. The valve system V is disposed in a valve chamber 13 defined by the cylinder head 2 and the valve cover 3.

Air induced through an inlet system of the internal combustion engine E which is mounted on a side portion 2*i* of the cylinder head 2 where an entrance to the inlet port 6 is opened is mixed with fuel injected from a fuel injection valve 14 mounted on the cylinder head 2 is induced into the combustion chamber 5 via the inlet 11 which are opened on an induction stroke after having passed through the inlet port 6, and the resulting air-fuel mixture is then compressed on a compression stroke in which the piston 4 moves upwards. The air-fuel mixture is ignited to be burnt in a final stage on the compression stroke, and on a power stroke in which the piston 4 moves downwards, the resulting pressure rise in gases produced after combustion drives the piston 4 downwards to spin the crankshaft. The combustion gases are expelled from the combustion chamber 5 to pass through the exhaust port 7 via exhaust valves 12 which are opened on an exhaust stroke in which the piston 4 moves upwards as exhaust gases and are then discharged to the outside of the internal combustion engine E through an exhaust system mounted on a side portion 2*e* of the cylinder head 2 to which an exit from the exhaust port 7 is opened.

The valve system V that is provided on the cylinder head 2 is made up of an inlet-side valve system Vi which includes an inlet camshaft 15 on which inlet cams 15*a*, which are valve cams, are provided and actuates the inlet 11 to open and close them and an exhaust side valve system Ve which includes an exhaust camshaft 16 on which exhaust cams 16*a*, which are valve cams, are provided and actuates the exhaust valves 12 to open and close them. In addition, in this embodiment, the inlet side valve system Vi is made up of a variable valve system which can vary valve operation characteristics of the inlet 11 which include a maximum lift amount thereof according to the running conditions of the internal combustion engine E.

Both the camshafts 15, 16, which are disposed on opposite sides across a center plane Pc, which includes a cylinder axis Lc and which is parallel to a rotational center line Li of the inlet camshaft 15, in a direction which intersects the center plane Pc (hereinafter, referred to as an "orthogonal direction"), are rotatably supported on the cylinder head 2 via a camshaft holder which is provided integrally on the cylinder head 2 in such a manner as to be both in parallel with a rotational center line of the crankshaft and to have rotational center lines Li, Le which are parallel to each other. The camshaft holder has a plurality of bearing portions 17 which are provided on the cylinder head at intervals in a direction of the rotational center line Li of the inlet camshaft 15 (which is the direction in which the cylinders 1*a* are aligned, and hereinafter, referred to as an "axial direction"). Each bearing portion 17 is made up of a lower bearing portion 17*a* which is molded integrally on the cylinder head 2 and an upper bearing portion which is connected to the lower bearing portion 17*a* with bolts. In addition, the upper bearing portion is made up of an inlet side first upper bearing portion 17*b* which supports a holder 30 and a control shaft 71, which will be described later on, an inlet side second upper bearing portion 17*c* which supports the inlet camshaft 15 and which is connected to the lower bearing portion 17*a* via the first upper bearing portion 17*b*, and an exhaust side upper bearing portion 17*d* which supports the exhaust camshaft 16.

Both the camshafts 15, 16 are driven to rotate at half camshaft speed by virtue of the power of the crankshaft that is transmitted thereto via a valve actuating mechanism 18 which includes a chain looped between a shaft end portion of the crankshaft and shaft end portions of both the camshafts 15, 16. Furthermore, a hydraulic variable phase unit 19 for varying the phase of the inlet camshaft 15 relative to the crankshaft according to the running conditions of the internal combustion engine E is provided on a power transmission path between the valve actuating mechanism 18 and the inlet camshaft 15.

In addition, one inlet cam 15*a*, which has a rotational center line Li and which is provided in a number which is equal to the number of transmission mechanisms T provided, which will be described later on, and a pair of exhaust cams 16, which have a rotational center line Le and which are provided in a number which is equal to the number of exhaust valves 12, are disposed between the bearing portions 17 which neighbor in the axial direction for each cylinder 1*a*. The inlet cam 15*a* is disposed at the center of the transmission mechanism T in the axial direction.

In addition to the exhaust camshaft 16 and the exhaust cams 16*a* which actuate to open and close the exhaust valves 12, the exhaust side valve system Ve includes, for each cylinder 1*a*, a pair of rocker arms 20 which relays the valve actuating force of the exhaust cams 16*a* to the exhaust valves 12, respectively. Each rocker arm 20, which is supported in such a manner as to oscillate on a rocker arm shaft 21 which is supported on the lower bearing portions 17*a*, contacts the exhaust cam 16*a* at a roller 20*a* thereof and has a pressurizing portion 20*b* having an adjustment screw which contacts, in turn, the exhaust valve 12 so as to pressurize the exhaust valve 12. The exhaust cam 16*a* oscillates the rocker arm 20 so as to open and close the exhaust valve 12 via the rocker arm 20.

Figure 3:
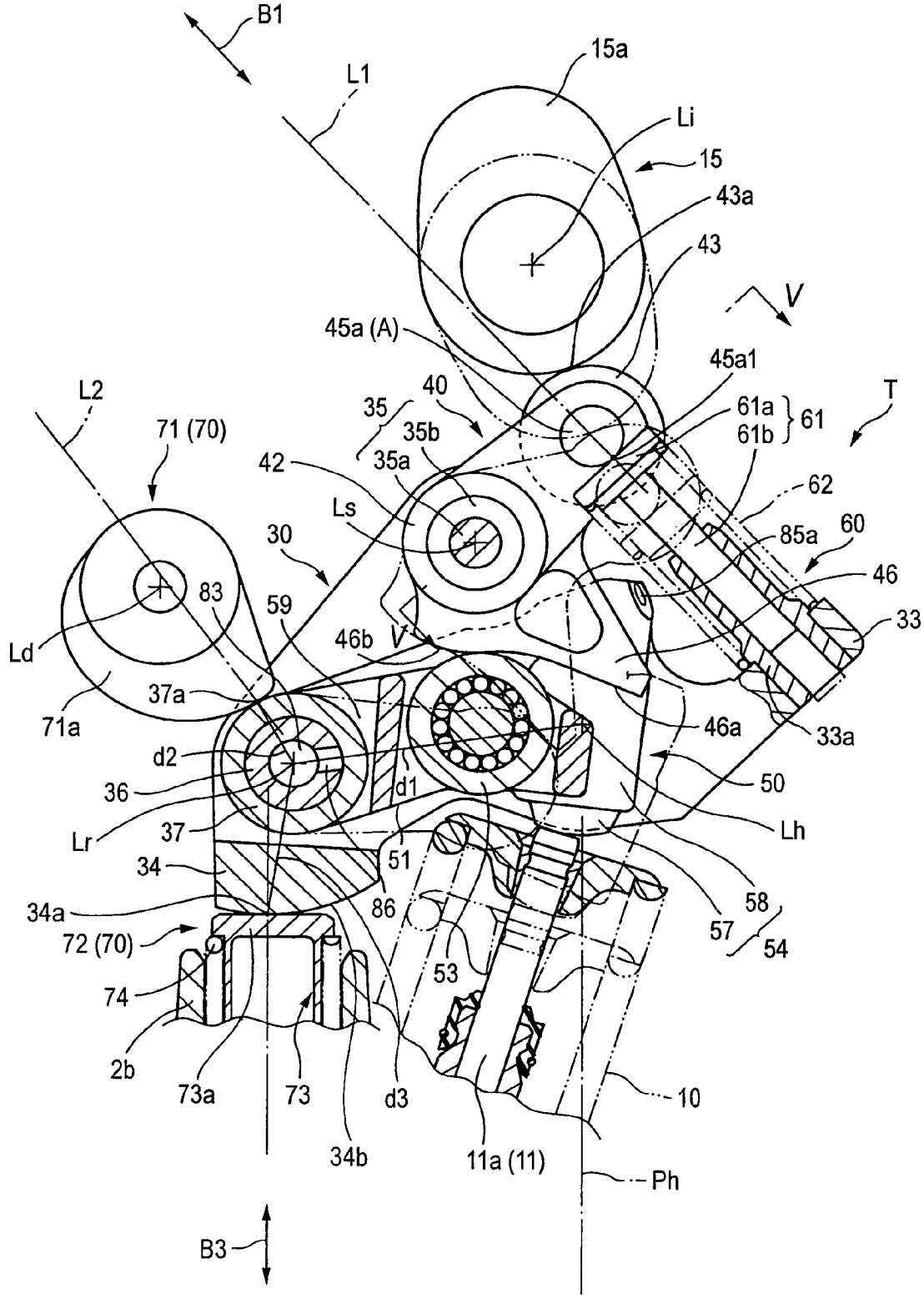
FIG. 3 is a sectional view taken along the line III-III in FIG. 2 with a sub-cam shown in side view which shows a state when a holder of a transmission mechanism of the variable valve system occupies a maximum lift position.
Figure 4A:
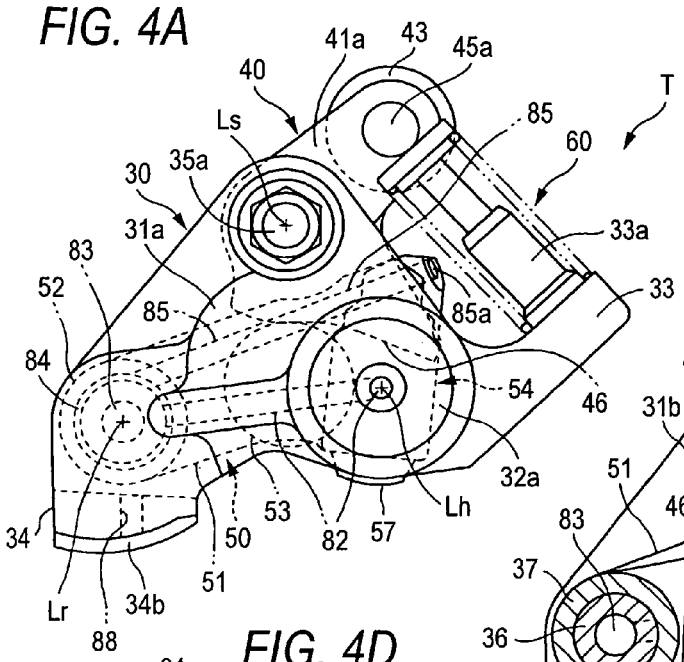
FIG. 4A is a side view of the transmission mechanism of the variable valve system shown in FIG. 1.
Figure 4B:
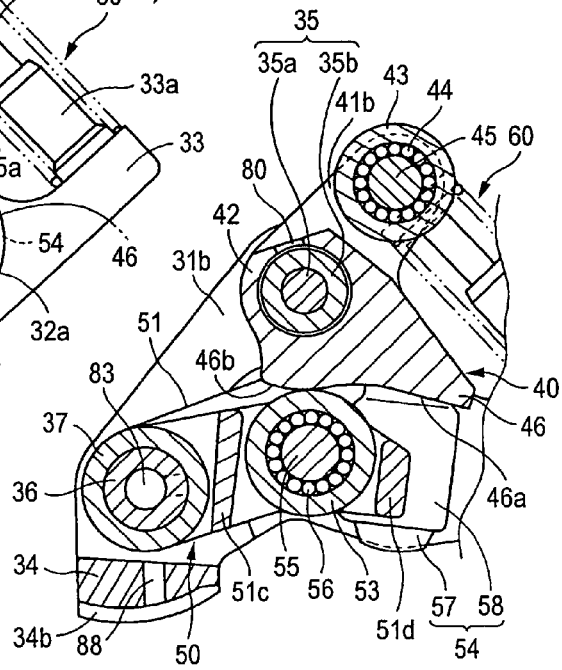
FIG. 4B is a sectional view of a main part of the transmission mechanism taken along the line b-b in FIG. 4C.
Figure 4D:
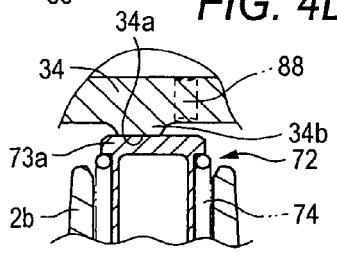
FIG. 4D is a sectional view of main parts of the holder and a controlling biasing mechanism taken along the line d-d in FIG. 4C.
Figure 4C:
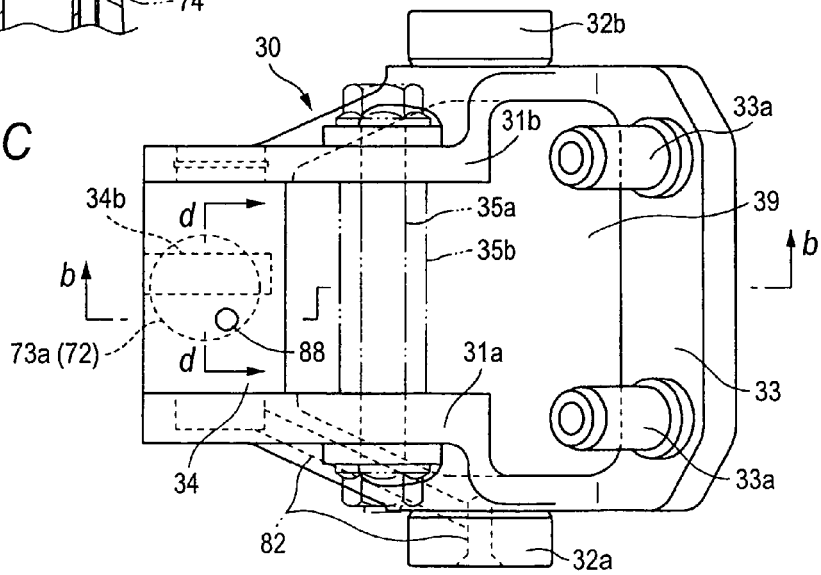
FIG. 4C is a plan view of the holder of the transmission mechanism.

Also, referring to FIGS. 3, 4, in addition to the inlet camshaft 15 and the inlet cam 15*a* which actuates to open and close the inlet valve 11, the inlet side valve system Vi includes a transmission mechanism T for transmitting the valve actuating force of the inlet cam 15*a* to the inlet valve 11 and varying a maximum lift amount of the inlet valve 11, a control member 70 for driving a holder 30 of the transmission mechanism T so as to vary the maximum lift amount, and a biasing member 60 for producing a biasing force which brings the transmission mechanism T into contact with the inlet cam 15*a*. Then, the control member 70 drives the holder 30 according to the running conditions of the internal combustion engine E to thereby vary a displacement of the holder 30 which is displaced relative to the cylinder head 2 or the maximum lift amount and opening and closing timings of the inlet valve 11 which are part of the valve operation characteristics according to the displacement of the holder 30.

The transmission mechanism T includes the holder 30 which is supported in such a manner as to be displaced, or in this embodiment, to oscillate relative to the cylinder head 2 about a holder center line Lh which is an oscillation center line as a displacement center line which is parallel to the rotational center line Li of the inlet camshaft 15 and is driven to oscillates (or to be displaced) by virtue of the controlling force of the control member 70, a sub-cam (a rocker member) 40 which functions as an input-side rocker member which is supported on the holder 30 in such a manner as to oscillates about an oscillation center line Ls and is driven to oscillate by the inlet cam 15*a*, and a rocker arm 50 which functions as an output-side rocker member which is supported on the holder 30 in such a manner as to oscillate about an oscillation center line Lr and is driven to oscillate by the sub-cam 40. The rocker arm 50 applies the valve actuating force transmitted thereto via the sub-cam 40 to the inlet valve 11. In addition, the holder center line Lh, both the oscillation center lines Ls, Lr and a rotational center line Ld of a control shaft 71 are parallel to the rotational center lines Li, Le of the respective camshafts 15, 16.

The control member 70 is made up of the control shaft 71 which is supported rotatable relative to the cylinder head 2 and is driven to rotate by an electric motor M as an actuator which is mounted on the cylinder head 2 in a position lying outside the valve chamber 13, and a controlling biasing member 72 which is accommodated in a cylindrical accommodating portion 2*b* which is provided on the cylinder head 2 by being integrally molded therewith. A control cam 71*a* is provided on the control shaft 71, whose rotational position is controlled by the electric motor M, for relaying a driving force which oscillates or stops the holder 30 to the holder 30. The control cam 71*a* has a cam surface which is formed into an involute configuration.

The electric motor M is controlled by an electronic control unit to which a detection signal from a running state detecting unit for detecting the running state of the internal combustion engine E such as engine revolution speed and engine load, so as to drive the holder 30 in a rotational direction and at revolution speeds which are set according to the running states of the internal combustion engine E.

In addition, the controlling biasing member 72 is made up of a rod-shaped pressurizing member 73 having a pressurizing portion 73*a* which is brought into contact with a connecting wall 34 and a spring 74 which is made up of a coil spring which is a spring member which is accommodated in the accommodating portion 2*b* and is disposed between the accommodating portion 2*b* and the pressurizing portion 73*a* in such a manner as to surround the pressurizing member 73. Since the accommodating portion 2*b* is connected to the holding portion 2*a*, the rigidity of the accommodating portion 2*b* is enhanced, whereby the controlling biasing member 72 can be held stably therein.

The holder 30, which is disposed, for each cylinder 1*a*, below the inlet cam 15*a* between the bearing portions 17 which neighbor in the axial direction, has, as viewed from the axial direction (which is also the direction of the holder center line Lh or the respective oscillation center lines Ls, Lr) (hereinafter, referred to as "as viewed from the side"), a pair of arm portions 31*a*, 31*b* which are spaced apart in the axial direction, a pair of connecting walls 33, 34 which connect together both end portions of the respective arm portions 31*a*, 31*b* in the orthogonal direction, respectively, a pair of cylindrical holder fulcrum portions 32*a*, 32*b* which are provided on the arm portions 31*a*, 31*b*, respectively, in such a manner as to protrude therefrom in directions in which the fulcrum portions move away from each other and which are pivotally supported on the bearing portions 17, and a first support shaft 35 as a support portion and a rocker shaft 36 which is a second support shaft as a support portion which are disposed closer to the cylinder axis Lc than the holder fulcrum portions 32*a*, 32*b* in the orthogonal direction so as to pivotally support the sub-cam 40 and the rocker arm 50, respectively. Here, the pair of arm portions 31*a*, 31*b*, the pair of holder fulcrum portions 32*a*, 32*b* and the pair of connecting walls 33, 34 are molded integrally so as to configure a single member, and the single member is such as to be defined by the pair of arm portions 31*a*, 31*b* and the pair of connecting walls 33, 34 into a frame-shaped member which defines an accommodating space 39 which accommodates therein the sub-cam 40 and the rocker arm 50.

The pair of connecting walls 33, 34 are provided in the positions which hold the holder fulcrum portions 32*a*, 32*b* therebetween in the orthogonal direction (or as viewed from the side). The holder center line Lh which is specified by the pair of holder fulcrum portions 32*a*, 32*b* is positioned on an extension of a valve stem 11*a* of the inlet valve 11. The support shaft 35 is made up of a bolt 35*a* which passes through boss portions of the respective arm portions 31*a*, 31*b* and a cylindrical shaft portion 35*b* which is passed over the bolt 35*a* for support thereon (also, refer to FIG. 5). The rocker shaft 36 is made up of a cylindrical shaft which is inserted into the respective arm portions 31*a*, 31*b* and is then prevented from being dislocated therefrom by a snap ring. In addition, both the connecting walls 33, 34 are portions whose rigidity is increased for enhancing the rigidity of the holder 30, and the support shaft 35 and the rocker shaft 36 are portions whose rigidities are increased for supporting the sub-cam 40 and the rocker arm 50, respectively.

The connecting wall 34 and the rocker shaft 36 are disposed on one side (or on a cylinder axis Lc side) of the holder 30 relative to a holder center plane Ph (refer to FIG. 3) which includes the holder center line Lh and which is parallel to the rotational center line Li in the orthogonal direction, while the connecting wall 33 and the biasing member 60 are disposed on the other side (on an opposite side to the cylinder axis Lc side). Since the imbalance in weight on the opposite sides of the holder 30 across the holder center line Lh as the center is reduced by disposing the connecting wall 34 and the rocker shaft 36, and the connecting wall 33 and the biasing member 60 on the opposite sides to each other across the holder center line Lh in the way described above, the driving of the holder 30 by the control member 74 is facilitated.

Figure 5:
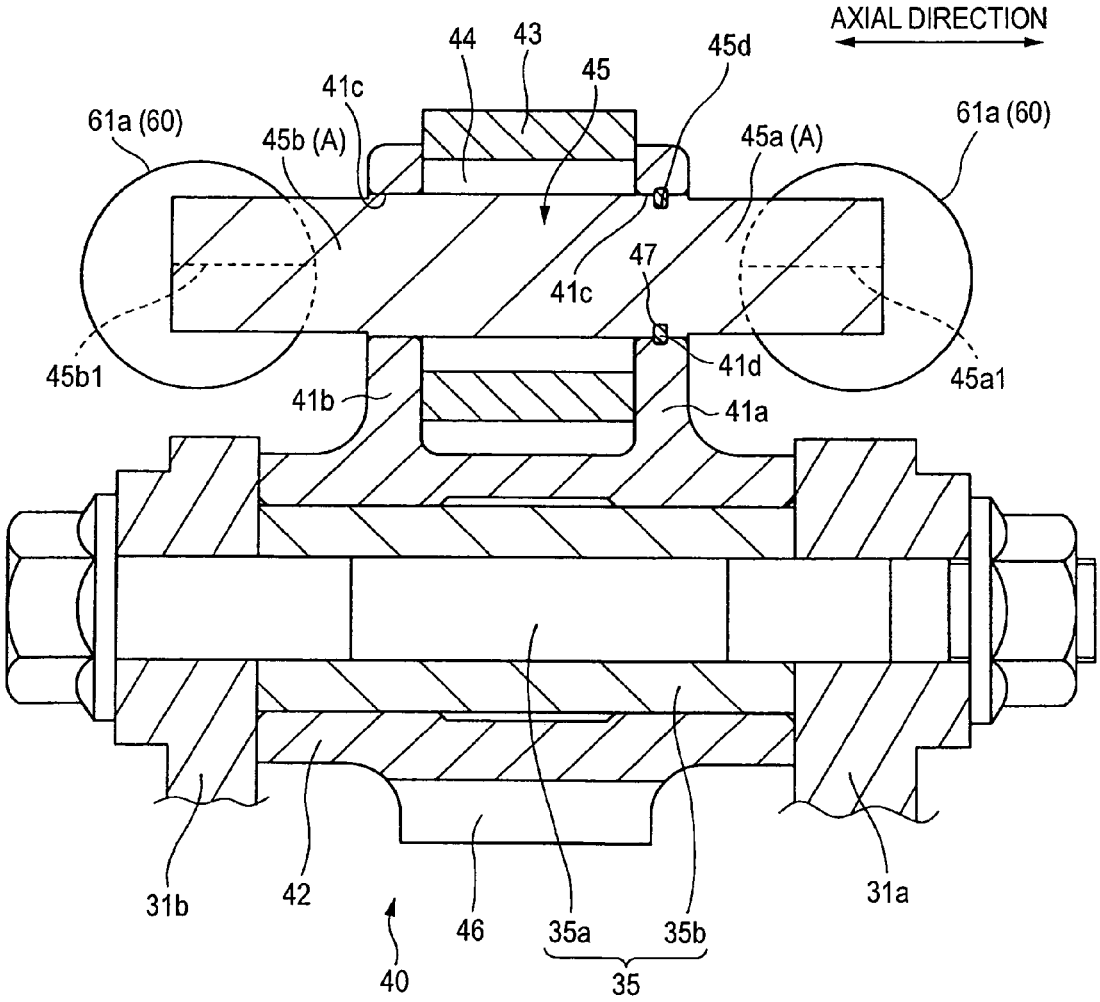
FIG. 5 is a sectional view of the main part of the variable valve system taken along the line V-V in FIG. 3.

Also, referring to FIG. 5, the sub-cam 40, which is disposed above the rocker arm 50, has a cylindrical fulcrum portion 42 which is fitted on an outer circumference of the shaft 35*b* and is supported on the support shaft 35 which specifies the oscillation center line Ls in such a manner as to oscillate thereon, a roller 43 which functions as a cam contact portion which is brought into contact with the inlet cam 15*a*, a support shaft 45 which rotatably supports the roller 43 on an outer circumference thereof via a bearing 44 which is made up of a large number of needle rollers, a pair of arm portions 41*a*, 41*b* which protrude from the fulcrum portion 42 and in which the support shaft 45 is provided in such a manner as to oscillate, as well as rotate, a drive cam portion 46 as an output portion which extends from the fulcrum portion 42 towards the connecting portion 33, and acting portions A which are brought into contact with the biasing members 60.

The roller 43, which is provided on the support shaft 45, is brought into rolling contact with the inlet cam 15*a* at its cam contact point 43*a* (refer to FIG. 3). An oil hole 80 (refer to FIG. 4B) is provided in the fulcrum portion 41 in such a manner as to open upwards, so that lubricating oil that is scattered within the valve chamber 13 is supplied from the oil hole to a sliding portion between the shaft 35*b* of the support shaft 35 and the fulcrum portion 42, the fulcrum portion 42 being thereby lubricated.

The cam contact point 43*a*, biased contact points 45*a*1, 45*b*1, 48*a*, which will be described later on, and acting points 34*a*, 37*a* include, respectively, contact points and acting points which are formed into a linear or planar shape as well as those which are points, and in the event that the contact points or acting points are linear or planar, their acting lines L1, L2, L3 are straight lines which pass through arbitrary points which are included in the contact points or acting points.

The drive cam portion 46 outputs the valve actuating force of the inlet cam 15*a* which is inputted from the roller 43 to the pair of inlet 11 via the rocker arm 50. A cam surface of the drive cam portion 46 which drives the rocker arm 50 is made up of a drive surface 46*a* which oscillates the rocker arm 50 through oscillation of the sub-cam 40 so as to put the inlet 11 in an open state and a non-drive surface 46*b* which does not oscillates the rocker arm 50 regardless of oscillation of the sub-cam 40 so as to keep the inlet 11 in a closed state. The non-drive surface 46*b* is made up of a cylindrical surface centered at the oscillation center line Ls. In addition, when a roller 53 of the rocker arm 50 is brought into contact with the drive surface 46*a*, the inlet 11 are put in the open state, whereas when the roller 53 is brought into contact with the non-drive surface 46*b*, the inlet 11 are put in the closed state.

Referring to FIG. 5, the support shaft 45, which is passed through holes 41*c* in the respective arm portions 41*a*, 41*b* so as to be fitted therein in such a manner as to slide and rotate relative to the respective arm portions 41*a*, 41*b*, is restricted with respect to longitudinal (and also axial) movements by a snap ring 47 which is mounted in such a manner as to straddle a circularly annular mounting groove 41*d* provided on a circumferential wall of the through hole 41*c* in the arm portion 41*a* and an annular mounting groove 45*d* provided on an outer circumference of the support shaft 45.

Referring to FIGS. 1 to 5, the pair of acting portions A of the support shaft 45, which are disposed to lie on both sides of the roller 43 in the longitudinal direction of the relevant shaft, are made up of cylindrical shaft end portions 45*a*, 45*b* of the support shaft 45 which protrude axially in opposite directions to the roller 43 or in directions in which they move away from the roller 43 with the respective arm portions 41*a*, 41*b* held therebetween in the axial direction. The pair of biasing members 60 are brought into contact with both the shaft end portions 45*a*, 45*b*, respectively.

The biasing members 60 are disposed on sides of the pair of arm portions 41*a*, 41*b* in such a manner as to hold the roller 43 and the pair of arm portions 41*a*, 41*b* therebetween in the axial direction and are held on to the connecting wall 33. Each biasing member 60 is made up of a pressurizing member 61 which is made up, in turn, of a disc-shaped pressurizing portion 61*a* which is adapted to be brought into contact with the shaft end portion 45*a* or 45*b* at a biased contact point 45*a*1 or 45*b*1 thereof so as to apply a biasing force to the shaft end portion 45*a* or 45*b* and a cylindrical rod 61*b* which is made smaller in diameter than the pressurizing portion 61*a*, and a spring 62 which is made up of a compression coil spring as a spring member which is disposed between the pressurizing portion 61*a* and the connecting wall 33. The rod 61*b* slidably fits in a cylindrical guide tube 33*a* which is fixedly press fitted in the connecting wall 33 so as to function as a guide portion. Since the rod 61 and the guide tube 33*a* which protrudes from the connecting wall 33 towards the roller 43 are disposed inside the spring 62 by making use of an inner space defined by being surrounded by the spring 62, the enlargement of the connecting wall 33 which holds the biasing members 60 is suppressed.

The respective shaft end portions 45*a*, 45*b* are provided in the vicinity of the roller 43 in such a manner that the biased contact points 45*a*1, 45*b*1 are positioned nearer to the cam contact point 43*a* than the oscillation center line Ls and the drive cam portion 46 (refer to FIGS. 3, 5) and that the acting line Li (refer to FIG. 3) of the biasing force at the biased contact points 45*a*1, 45*b*1 is superposed on the roller 43 and the inlet cam 15*a* as viewed from the side (that is, as viewed from the direction of the oscillation center line Ls). More specifically, the pressurizing portions 61*a* lie in positions where they are superposed on the roller 43 as viewed from the side and are brought into contact with the shaft end portions 45*a*, 45*b*, respectively, between the pair of arm portions 31*a*, 31*b* (refer to FIG. 5).

The biasing member 60, which lies in a position where it is entirely superposed on the acting line Li in a direction B1 of the acting line Li, is disposed in the position in such a manner as to be superposed on the drive cam portion 46 and the fulcrum portion 42 in the acting line direction B1, as well as one of a pair of arm portions 51, one of a pair of valve pressurizing portions 54 and the roller 53 of the rocker arm 50.

Referring to FIGS. 2 to 4 and 6, the rocker arm 50 has a pair of fulcrum portions 52 which are fitted on an outer circumference of the rocker shaft 36 which specifies the oscillation center line Lr in such a manner as to slide thereon and are supported on the rocker shaft 36 in such a manner as to oscillate, the pair of arm portions 51 which extend towards the holder center line Lh from the fulcrum portions 52, respectively, the roller 53 which is a follower contact portion which is brought into contact with the cam surface of the drive cam portion 46, and the pair of valve pressurizing portions 54 which are provided at distal end portions of the arm portions 51, respectively, so as to be brought into contact with the valve stems 11*a* of the pair of inlet 11, respectively.

The pair of fulcrum portions 52 are disposed in such a manner as to hold therebetween a roller 37, which will be described later on, in the axial direction. The roller 53, which is brought into rolling contact with the cam surface of the drive cam portion 46 is rotatably supported on a support shaft 55 which is provided in such a manner as to be inserted into both the arm portions 51 via a bearing 56 which is made up of a large number of needle rollers. The rigidity of the rocker arm 50 is enhanced by a connecting wall 51*c* which is provided between the roller 53 and both the fulcrum portions 52 in the orthogonal direction so as to connect both the arm portions 51 together and a connecting wall 51*d* (refer to FIG. 4B) which connects both accommodating portions of the valve pressurizing portions 54 together.

Figure 6:
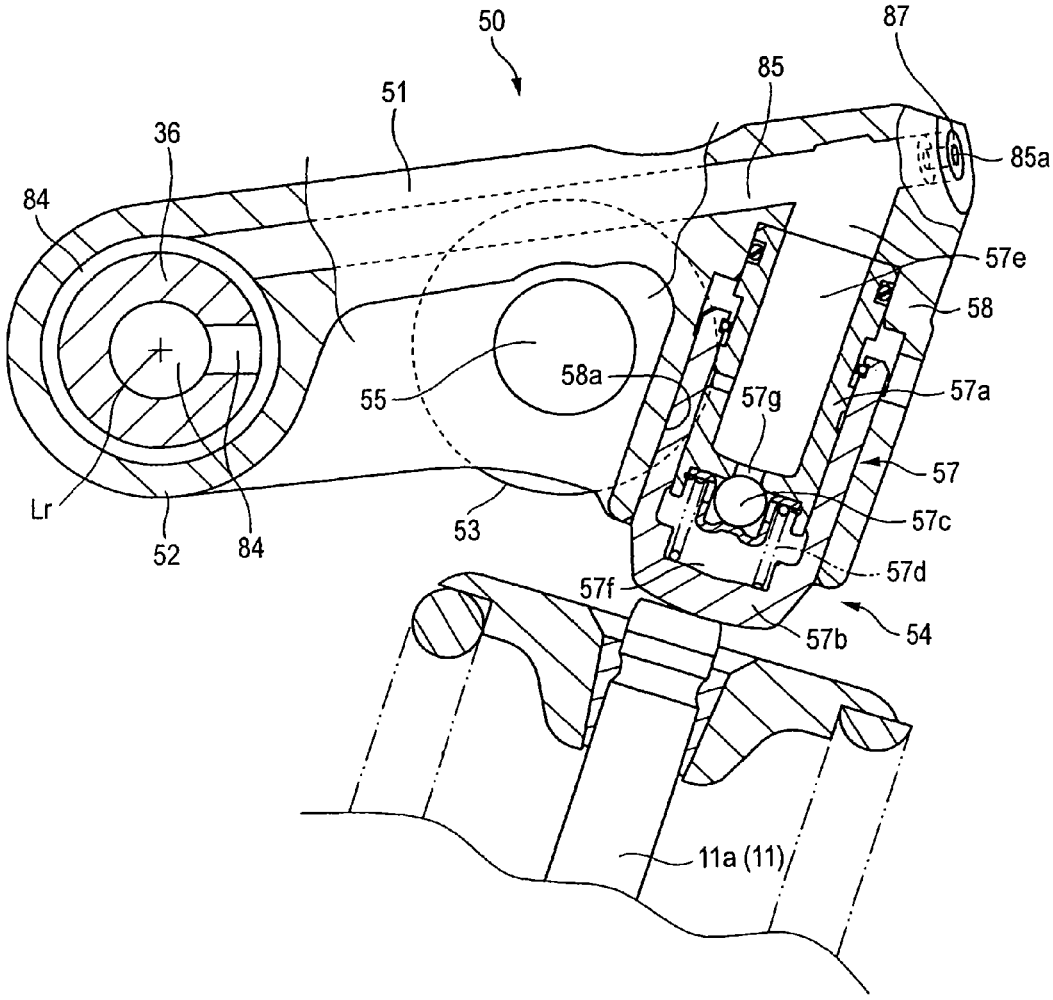
FIG. 6 is a side view of a rocker arm of the transmission mechanism of the variable valve system shown in FIG. 1 with part thereof shown in section.

Referring to FIG. 6, the pair of valve pressurizing portions 54, which are spaced apart in the axial direction, are each made up of a hydraulic clearance adjusting member 57 for adjusting a valve clearance of the inlet valve 11 and the accommodating portion 58 which defines an accommodating bore 58*a* to accommodate therein the clearance adjusting member 57.

The clearance adjusting member 57 includes a cylindrical inner 57*a* and outer 57*b* which are both accommodated in the accommodating bore 58*a* which is made to open in the direction of the inlet valve 11, a check valve 57*c* and a spring 57*d* which is disposed between the inner 57*a* and the outer 57*b*. The accommodating portion 58 defines, in cooperation with the inner 57*a*, an oil chamber 57*e* which communicates with an oil passage 85 provided in the rocker arm 50, and an oil chamber 57*f* which accommodates therein the check valve 57*c* and the spring 57*d* is defined between the inner and the outer 57*b* which is brought into contact with the valve stem 11*a*. Both the oil chambers 57*e*, 57*f* are made to communicate with each other through an oil hole 57*g* which is provided in the inner 57*a* in such a manner as to be opened and closed by the check valve 57*c*. Then, the outer 57*b* is pushed by virtue of the pressure of lubricating oil within the oil chamber 57*f* so as to be brought into contact with the valve stem 11*a*, so that the valve clearance is automatically adjusted to become zero.

Referring to FIGS. 2, 4 and 6, the pair of oil passages 85 which are provided in the rocker arm 50 are each formed in such a manner as to extend in a straight line from the valve pressurizing portion 54 to the fulcrum portion 52 via the arm portion 51 through a single drilling operation from a valve pressurizing portion 54 side of the rocker arm 50. Each oil passage 85 has as an end portion thereof an injection opening 85*a* from which lubricating oil is injected towards the biasing member 60 and extends as far as the fulcrum portion 52, where the oil passage 85 communicates with a circularly annular oil supply passage 84 which is provided in such a manner as to surround the rocker shaft 36. Then, the biasing member 60 is disposed on an extension from the oil passage 85 (refer to FIG. 2).

Lubricating oil that is discharged from an oil pump to be led to the cylinder head 2 is supplied to the oil supply passage 84 from an oil passage 81 provided in the lower bearing portion 17*a* via an oil passage 82 which is provided in one of the holder fulcrum portions 32*a* and one of the arm portions 31*a* and communicates with the oil passage 81 in the holder fulcrum portion 32*a* and an oil passage 83 which is provided in the rocker shaft 36 and communicates with the soil supply passage 84 in each fulcrum portion 52. In addition, an oil passage 86 is provided in the rocker shaft 36 which supplies the lubricating oil in the oil passage 83 to a sliding portion between the roller 37 and the rocker shaft 36.

The oil passage 85 communicates with a highest portion of the oil chamber 57*e*, and the injection opening 85*a* of the oil passage 85 doubles as an air vent hole for discharging air accumulated within the oil chamber 57*e*. In addition, an orifice 87 is press fitted in the injection opening 85*a* which secures an oil pressure of a predetermined value or higher within the oil chamber 57*e* and allows lubricating oil to be injected towards the biasing member 60 in the form of a jet of lubricating oil.

Referring to FIGS. 1 to 3, the control cam 71*a* and the controlling biasing member 72 are disposed in positions which are opposite to each other across the oscillation center line Lr or the rocker shaft 36 in the direction of the acting line L3 of the biasing force at an acting point 34*a* on the connecting wall 34 with which the pressurizing member 73 of the controlling biasing member 72 is brought into contact. The control cam 71*a* contacts the roller 37, which is a first contact portion, at an acting point 37*a* thereof so as to apply a driving force of the control cam 71*a* thereto, while the pressurizing portion 73*a* of the controlling biasing member 72 contacts the connecting wall 34, which is a second contact portion, or more specifically, a raised portion 34*b* provided on the connecting wall 34 at the acting point 34*a* so as to apply a controlling biasing force thereto. Here, the driving force and the controlling biasing force make up a controlling force of the control member 70, and the roller 37 and the connecting wall 34 make up a controlling acting portion to which the controlling force of the control member 70 is applied.

In addition, a distance d2 between the acting point 37*a* to which the driving force is applied and the oscillation center line Lr and a distance d3 between the acting point to which the controlling biasing force is applied and the oscillation center line Lr are smaller than a distance d1 between the holder center line Lh and the oscillation center line Lr.

Additionally, the acting line L2 of the driving force and the acting line L3 of the controlling biasing force are superposed on the rocker shaft 36 as viewed from the side and intersect the rocker shaft 36 in this embodiment. In addition, both the acting points 37*a*, 34*a* are positioned in such a manner as to be superposed on a central portion of the holder 30 in the axial direction and on a center line of the holder 30 in the axial direction as viewed from the top.

The pressurizing portion 73*a* is brought into contact with the raised portion 34*b* in the vicinity of the oscillation center line Lr. More specifically, the distance d2 is set to be substantially twice or less than twice as long as the distance d3, and the distance d2 is substantially one fourth or less of the distance d1.

The roller 37 is accommodated in an accommodation space 59 which is defined by the pair of fulcrum portions 52 which are disposed on both sides of the roller 37 in such a manner as to hold the roller 37 therebetween in the direction in which the pair of valve pressurizing portions 54 are aligned (and which is also the axial direction).

Furthermore, as is shown in FIG. 1, the control cam 71*a*, the controlling biasing member 72 and the roller 37 are disposed in positions which intersect a plane Pd which is parallel to the cylinder axis Lc and the rotational center line of the inlet cam 15*a*.

In addition, an oil passage 88, which is made up of a through hole which is directed towards the pressurizing portion 73*a* in a vertical direction or a direction B3 of the acting line L3, is formed in the connecting wall 34, so that lubricating oil which adheres to an upper surface of the connecting wall 34 is supplied to the acting point 34*a* which is a sliding portion between the pressurizing portion 73*a* and the raised portion 34*b* through the oil passage 88 so formed, whereby the acting point 34*a* and a sliding portion between the spring 74 and the accommodating portion 2*b* are lubricated.

Next, referring to FIGS. 3 and 7, the operation of the inlet-side valve system Vi will be described.

For example, when the internal combustion engine E is running in a high engine speed region or in a high load region, the holder 30 occupies a maximum lift position which is shown in FIG. 3. As this occurs, the control cam 71*a* contacts the roller 37 in a position where the height of a cam lobe becomes highest within a rotational range thereof. Then, the sub-cam 40, which is driven to rotate in a clockwise direction by the rotating inlet cam 15*a*, rotates the rocker arm 50 in the clockwise direction by the drive surface 46*a* of the drive cam portion 46, and the inlet valve 11 is then opened in a maximum lift amount which becomes maximum within a variable range of the maximum lift amount which is varied by the transmission mechanism T when the inlet cam 15*a* contacts the roller at an apex of the cam lobe thereof. In FIG. 3, positions of the inlet cam 15*a*, the sub-cam 40, the rocker arm 50, the biasing member 60 and the inlet valve 11 which are taken thereby when the inlet valve 11 is so opened are shown by chain double-dashed lines, and positions of the inlet cam 15*a*, the sub-cam 40, the rocker arm 50 and the biasing member 60 which are taken thereby when the roller 43 contacts a base circle of the inlet cam 15*a* and the roller 53 contacts the non-drive surface 46*b*, whereby the inlet valve 11 is closed are shown by solid lines.

Then, when the running state of the internal combustion engine E is shifted to a low engine speed region or a low load region, as the control shaft 71 is driven by the electric motor M (refer to FIG. 2) to rotate in a counterclockwise direction, the holder 30, which is being biased by the controlling biasing member 72, rotates about the holder center line Lh in the clockwise direction when the roller 37 is brought into contact with a lower portion of the cam lobe of the control cam 71*a*. When the holder 30 so rotates, the oscillation center line Lr rotates in the clockwise direction, and at the same time, the roller 43 is caused to rotate about the oscillation center line Ls in the counterclockwise direction by the biasing members 60 which contact the shaft end portions 45*a*, 45*b*, whereby the roller 53 comes into contact with the drive cam portion 46 in a position where a shift from a drive surface 46*a* side to a non-drive surface 46*b* side is completed. Because of this, when the rocker arm 50 is driven by the drive surface 46*a*, the maximum lift amount of the inlet valve 11 is reduced continuously. As this occurs, in the event that the variable phase unit 19 (refer to FIG. 2) performs no phase control, the opening timing of the inlet valve 11 is delayed continuously, whereas the closing timing is advanced continuously, so that a valve opening duration is shortened continuously, and furthermore, a timing when the maximum lift amount is attained is advanced continuously.

Figure 7:
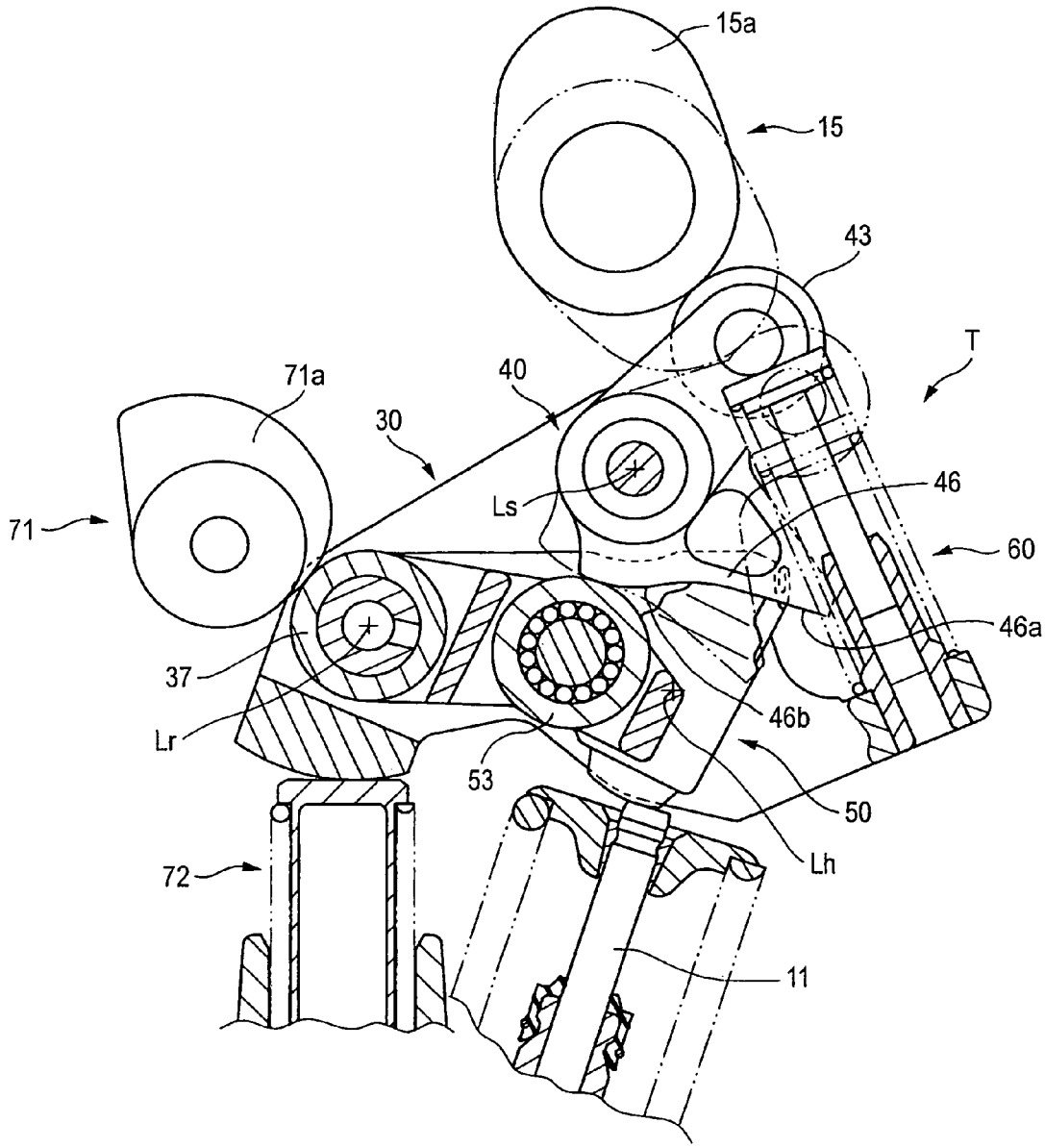
FIG. 7 is a view, corresponding to FIG. 3, which shows a state resulting when the holder occupies a minimum lift position.

The control shaft 71 rotates further in the counterclockwise direction, and the holder 30 then occupies a minimum lift position shown in FIG. 7. As this occurs, the control cam 71*a* contacts the roller 37 in a position where the height of the cam lobe becomes lowest within the rotational range thereof. Then, although the sub-cam 40 is driven to rotate in the clockwise direction by the rotating inlet cam 15*a*, since the roller 53 contacts only the non-drive surface 46*b* of the drive cam portion 46, the rocker arm 50 does not rotate about the oscillation center line Lr, whereby the inlet valve 11 is kept in the closed state even when the inlet cam 15*a* contacts the roller 43 at the apex of the cam lobe thereof. In FIG. 7, positions of the inlet cam 15*a*, the sub-cam 40 and the biasing member 60 which are taken thereby when the inlet valve 11 is kept closed held in such a state are shown by chain double-dashed lines, whereas positions of the inlet cam 15*a*, the sub-cam 40, the rocker arm 50 and the biasing member 60 which are taken thereby when the inlet valve 11 is in the closed state as a result of the roller 43 contacting the base circle of the inlet cam 15*a* are shown by solid lines. Consequently, in the maximum lift position, the maximum lift amount becomes zero, so that the inlet valve can be put in a rest state.

In addition, when the control shaft 71 rotates in the clockwise direction, whereby the holder 30 rotates from the state shown in FIG. 7 where the holder 30 occupies the minimum lift position towards the maximum lift position shown in FIG. 3, the transmission mechanism T operates reversely to what has been described above, whereby the maximum lift amount of the inlet valve 11 increases continuously.

Next, the function and advantage of the embodiment that is configured as has been described heretofore will be described.

The respective shaft end portions 45*a*, 45*b*, which function as the acting portions A of the sub-cam 40, are provided in the vicinity of the sub-cam 40 in such a manner that the biased contact points 45*a*1, 45*b*1 are positioned nearer to the roller 43 than the oscillation center Ls and that the acting line L1 of the biasing force is superposed on the roller as viewed from the side, whereby distances between the roller 43 and the biased contact points 45*a*1, 45*b*1 can be shortened, and therefore, not only is the sub-cam 40 made smaller in size and lighter in weight but also the deformation of the sub-cam 40 between the roller 43 and the biased contact points 45*a*1, 45*b*1 is suppressed. As a result, the following capability of the sub-cam 40 to the inlet cam 15*a* is increased, and hence, the opening and closing control accuracy of the inlet valve 11 is increased.

Since the cam contact portion is the roller 43 which is provided on the support shaft 45 which is rotatably provided on the arm portions 41*a*, 41*b* of the sub-cam 40 and the acting portions A are the cylindrical shaft end portions 45*a*, 45*b* which protrude in the opposite directions to the roller 43 or in the directions in which they protrude away from the roller 43 with the arm portions 41*a*, 41*b* held therebetween, the acting portions A can easily be provided in the vicinity of the roller 43 which is the cam contact portion, and since the shaft end portions 45*a*, 45*b* are positioned on the opposite sides to the roller 43 with the arm portions 41*a*, 41*b* held therebetween, the arm portions 41*a*, 41*b* can be made to lie nearer to the roller 43 in the axial direction, whereby the arm portions 41*a*, 41*b* can be made smaller in size in the axial direction, and the sub-cam 40 can be made lighter in weight. In addition, since the shaft end portions 45*a*, 45*b* can rotate, the occurrence of unbalanced wear of the shaft end portions 45*a*, 45*b* due to contact with the biasing members 60 can be prevented, the durability of the acting portions A being thereby increased.

The holder 30 has the pair of arm portions 31*a*, 31*b* which support the sub-cam 40 and which are spaced apart from each other in the axial direction and the connecting wall 33 which connects together the pair of arm portions 31*a*, 31*b*, and the basing members 60 are disposed to lie on the sides of the roller 43 in the axial direction and are held on to the connecting wall 33, whereby the biased contact points 45*a*1, 45*b*1 can be disposed near to the cam contact point 43*a* of the roller 43. Consequently, the sub-cam 40 is made smaller in size and lighter in weight, and moreover, the deformation of the sub-cam 40 between the cam contact point 43*a* and the biased contact points 45*a*1, 45*b*1 is suppressed. As a result of this, the following capability of the sub-cam 40 to the inlet cam 15*a* is increased, and the opening and closing control accuracy of the inlet valve 11 is increased. In addition, the biasing members 60 are disposed in such a manner as to hold the roller 43 therebetween, so as to bring the roller 43 into contact with the inlet cam 15*a* in a stable state, and the respective biasing members 60 are held on to the connecting wall 33 having high rigidity via the holder 30, these contributing to the increase in the opening and closing control accuracy of the inlet 11.

Since the biasing members 60 are disposed in the positions where they are superposed on the drive cam portion 46 which is accommodated within the accommodation space 39, the fulcrum portion 42, the arm portions 51, the valve pressurizing portions 54 and the roller 53 in the direction B1 of the acting line of the biasing force, the biasing members 60 are disposed by making use of the space defined in the transmission mechanism T for the drive cam portion 46, the fulcrum portion 42, the arm portions 51, the valve pressurizing portions 54 and the roller 53 to be disposed therein, thereby making it possible to make the variable valve system smaller in size.

The rocker arm 50 has the hydraulic clearance adjusting member 57 for adjusting the valve clearance of the inlet valve 11 and the accommodating portion 58 which accommodates therein the clearance adjusting member 57 and defines the oil chamber 57*e* in cooperation with the clearance adjusting member 57, and the injection opening 85*a*, which functions as the air vent hole for discharging air within the oil chamber 57*e*, is provided in the accommodating portion 58 in such a manner as to open towards the biasing member 60, whereby since the lubricating oil can be supplied to the biasing member 60 by making use of the air vent hole in the oil chamber 57*e* of the clearance adjusting member 57, the lubricating property of the biasing member 60 can be increased without forming separately an oil passage for supplying lubricating oil to the biasing member 60 by making use of the rocker arm 50 of the transmission mechanism T.

The rocker arm 50 has the fulcrum portions 52 which are supported on the holder 30 in such a manner as to oscillate thereon, the straight-line oil passage 85, which has the injection opening 85*a* which injects therefrom the lubricating oil towards the biasing member 60 at the end portion thereof and extends towards the fulcrum portion 52, is formed in the rocker arm 50, and the biasing member 60 is disposed on the extension of the oil passage 85, whereby since the lubricating oil is supplied to the biasing member 60 through the oil passage 85 formed in the rocker arm 50, the lubricating property of the biasing member 60 can be increased by the oil passage 85 provided by making use of the rocker arm 50 of the transmission mechanism T, and since the straight-line oil passage 85 can be formed through the single drilling operation, the formation of the oil passage 85 is facilitated.

The rocker arm 50 is supported on the arm portions 31*a*, 31*b* of the holder 30 in such a manner as to oscillate thereon, and the distances d2, d3 between the acting points 37*a*, 34*a* of the driving force which is the control force applied to the holder 30 by the control member 70 and the controlling biasing force and the oscillation center Lr of the rocker arm 50 is smaller than the distance d1 between the holder center line Lh and the oscillation center line Lr, or the acting lines L2, L3 of the driving force and the controlling biasing force are superposed on the rocker shaft 36 as viewed from the side, whereby since the controlling force of the control member 70 is applied to the holder 30 in the position lying in the vicinity of the oscillation center line Lr whose rigidity is increased so as to support the rocker arm 50, the deformation of the holder 30 is prevented which would otherwise be caused by loads such as the controlling force and the valve driving or actuating force while suppressing the increase in size and weight of the holder 30, and hence, the shift response of the holder 30 which is driven by the control member 70 is increased, the opening and closing control accuracy of the inlet valve 11 being thereby increased.

The control member 70 is made up of the control shaft 71 which contacts the roller 37 of the holder 30 to apply the driving force thereto and the controlling basing member 72 which contacts the connecting wall 34 of the holder 30 and generates the controlling biasing force which biases the roller 37 to the control cam 71*a* of the control shaft 71, and the controlling biasing member 72 contacts the connecting wall 34 in the vicinity of the oscillation center line Lr, whereby the controlling biasing member 72 contacts the connecting wall 34 in the vicinity of the rocker shaft 36. Consequently, the deformation of the holder 30 due to the controlling biasing force is suppressed, and hence, the following capability of the roller 37 to the control shaft 71 is increased, which contributes to the increase in the opening and closing control accuracy of the inlet valve 11.

Since the roller 37 to which the driving force from the control cam 71*a* is applied is supported by making use of the rocker shaft 36 which supports the rocker arm 50 through the contact of the control cam 71*a* with the roller 37 which is rotatably supported on the rocker shaft 36, the number of components is decreased, whereby the production costs are decreased.

The rocker arm 50 has the pair of valve pressurizing portions 54 which pressurize the pair of inlet 11 and the pair of fulcrum portions 52 which define the accommodation space 59 in which the roller 37 is accommodated and which are disposed on both the sides of the roller 37 in such a manner as to hold the roller 37 therebetween in the direction in which the pair of valve pressurizing portions 54 are aligned, whereby since the rocker arm 50 having the pair of valve pressurizing portions 54 is supported on the rocker shaft 36 at the pair of fulcrum portions 52, the inclination of the rocker arm 50 is prevented, so as to be supported in a stable fashion, and moreover, since the roller 37 is disposed within the accommodation space 59 which is defined between the pair of fulcrum portions 52, the movable valve system can be made smaller in size.

The control cam 71*a*, the controlling biasing member 72 and the roller 37 are disposed in the positions which intersect the single plane Pd which is parallel to the cylinder axis Lc and the rotational center line Li, whereby since the control cam 71*a*, the roller 37 and the controlling biasing member 72 are disposed to be aligned on the plane Pd, the deformation of the holder 30 is suppressed which would otherwise be caused by the driving force and the controlling biasing force, so that the transmission efficiency of the driving force and controlling biasing force to the holder 30 is increased, and furthermore, the following capability of the roller 37 to the control cam 71*a* based on the controlling biasing force is also increased, thereby making it possible to increase the opening and closing control accuracy of the inlet valve 11.

The controlling biasing member 72 contacts the connecting wall 34 which connects together the pair of arm portions 31*a*, 31*b* in the vicinity of the rocker shaft 36, whereby the controlling biasing force of the controlling biasing member 72 is applied to the connecting wall 34 whose rigidity is increased so as to increase the rigidity of the holder 30, this contributing to the increase in the opening and closing control accuracy of the inlet valve 11. Furthermore, since the raised portion 34*b* with which the controlling biasing member 72 is brought into contact is provided on the connecting portion 34, the rigidity of the connecting wall 34 is enhanced further.

Hereinafter, an embodiment in which part of the configuration of the embodiment that has been described heretofore is modified will be described with respect to a modified configuration.

Figure 8:
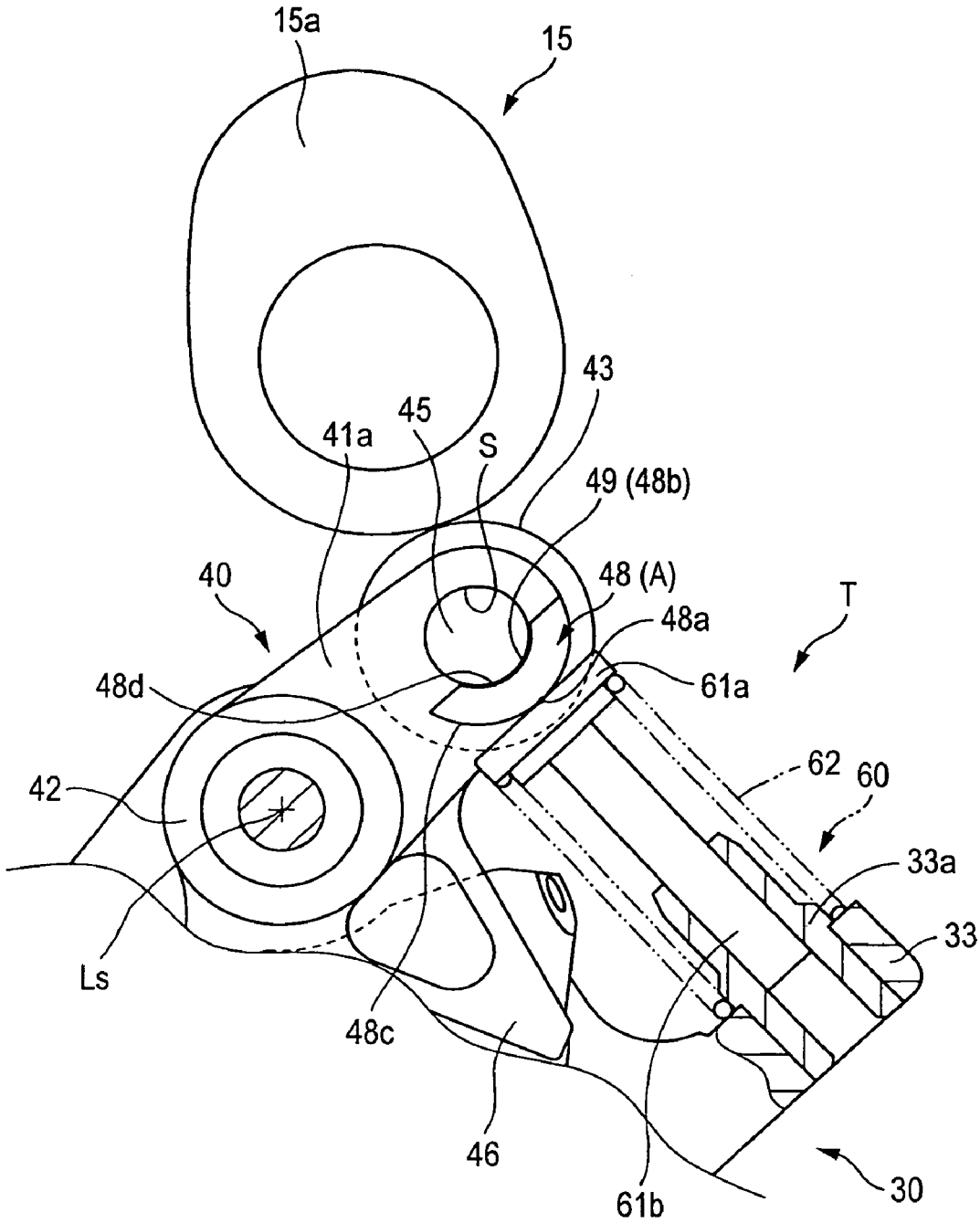
FIG. 8 is a view, corresponding to FIG. 3, which shows a main part of a modified example of a sub-cam of the transmission mechanism of the variable valve system shown in FIG. 1.
Figure 9:
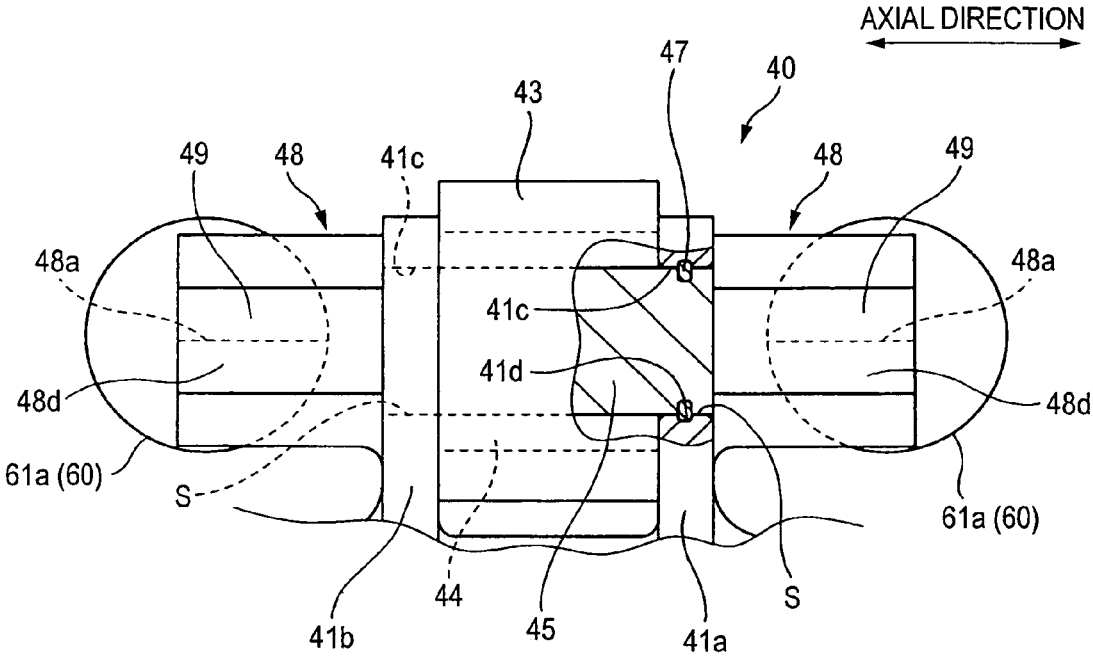
FIG. 9 is a view, corresponding to FIG. 5, which shows the main part of the modified example of the sub-cam shown in FIG. 8.

Referring to FIGS. 8, 9, a modified example of acting portions A of a sub-cam (rocker member) 40 will be described.

In this modified example, acting portions A is made up of a pair of protruding portions 48 which lie on opposite sides of respective arm portions 41*a*, 41*b* to a roller 43 with the arm portions 41*a*, 41*b* held therebetween and which protrude in axial directions from the arm portions 41*a*, 41*b*, respectively. The protruding portions 48 which are molded integrally on the arm portions 41*a*, 41*b*, respectively, are partially cylindrical portions in which recess portions 48*b* are formed which make up oil reservoir portions 49 for reserving therein lubricating oil that is to be supplied to sliding portions S between the arm portions 41*a*, 41*b* and a support shaft 45. The pressurizing portions 61*a* of the biasing members are brought into contact with the protruding portions 48 at biased contact points 48*a* on outer circumferential surfaces 48*c* which are made up of cylindrical surfaces of the protruding portions 48. A diameter of an inner circumferential surface 48*d* which is made up of a cylindrical surface of the recess portion 48*b* which is made to open upwards in a vertical direction is set not to be smaller than an outside diameter of the support shaft 45, and in this embodiment, the relevant diameter is made to be slightly larger than the outside diameter of the support shaft 45. Here, the protruding portions 48 are coaxial with the support shaft 45, and the outer circumferential surface 48*c* and the inner circumferential surface 48*d* of each of the protruding portions 48 have a center axis which coincides with a center axis of the support shaft 45. In addition, lubricating oil which is scattered within the valve chamber 13 falls in the oil reservoir portions 49 and is thereby received by the inner circumferential surfaces 48*d* to be reserved therein, and part of the lubricating oil so reserved is supplied to the sliding portions S. Furthermore, in the arm portion 41*a* where a mounting groove 41*d* in which a snap ring 47 is mounted is provided, the lubricating oil is supplied to a sliding portion between the snap ring 47 and the arm portion 41*a* and the support shaft 45. In addition, the protruding portions 48 function as guide portions for guiding the support shaft 45 into through holes 41*c* when the support shaft 45 is inserted into the arm portions 41*a*, 41*b*.

Therefore, according to this modified example, a cam contact portion is the roller 43 which is provided on the support shaft 45 which is rotatably provided in the arm portions 41*a*, 41*b*, and the acting portions A are the protruding portions 48 which lie on the opposite sides of the arm portions 41*a*, 41*b* to the roller 43 with the arm portions 41*a*, 41*b* held therebetween and protrude from the arm portions 41*a*, 41*b*, respectively, the protruding portions 48 having formed therein the oil reservoir portions 49 which reserve therein lubricating oil that is supplied to the sliding portions S between the arm portions 41*a*, 41*b* and the support shaft 45, whereby the acting portions A can easily be provided in the vicinity of the roller 43, and the protruding portions 48 are positioned to lie on the opposite sides of the arms portions 41*a*, 41*b* to the roller 43 with the arm portions 41*a*, 41*b* held therebetween. Because of this, since the arm portions 41*a*, 41*b* can be made to lie nearer to the roller 43 in the axial direction, the arm portions 41*a*, 41*b* can be made smaller in size in the axial direction, whereby the sub-cam 40 is made lighter in weight. Furthermore, since the lubricating oil reserved in the oil reservoir portions 49 formed in the protruding portions 48 is supplied to the sliding portions S, the lubricating property of the support shaft 45 are enhanced. In addition, since the protruding portions 48 can be used as the guide portions for the support shaft 45 when the support shaft 45 is built in the arm portions 41*a*, 41*b*, and the assembling property of the support shaft 45 is enhanced.

In addition, the support shaft 45 is restricted by the snap ring 47 mounted in the mounting groove 41*d* in the arm portion 41*a* with respect to axial movements, and the protruding portion is molded integrally on the arm portion 41*a* in which the mounting groove 41*d* of the snap ring 47 is provided, whereby since the rigidity of the arm portion 41*a* in which the mounting groove 41*d* is provided is enhanced by the protruding portion 48, the deformation of the arm portion 41*a* is suppressed which would otherwise be caused by the valve driving or actuating force which is applied to the arm portion 41*a* through the roller 43 and the support shaft 45. Consequently, by making use of the protruding portion 48 with which the biasing member 60 is brought into contact, the dislocation preventing effect of the snap ring 47 from the arm portion 41*a* is enhanced.

The biasing members 60 may be brought into contact with the acting portions A in other positions than the positions lying to the sides of the roller 43 in the axial direction on condition that the biased contact points of the acting portions A are situated nearer to the cam contact point 43*a* than the oscillation center line Ls. The biasing portion 60 may be provided one or more than two.

The cam contact portion may be made up of not the roller 43 but a portion or a member having a sliding surface such as a slipper. The follower contact portion may be made up of not the roller 53 but a portion or a member having a sliding surface such as a slipper. The roller 43 may be molded integrally with the support shaft 45.

In place of the inlet-side valve system, the exhaust-side valve system may be made up of the variable valve system, or both the inlet-side valve system and the exhaust-side valve system may be made up of the variable valve system. In addition, the valve system may by such as to have a single camshaft on which inlet cams and exhaust cams are provided. The inlet valve and the exhaust valve which are provided for each cylinder may be one or more than two for each.

The control member 70 may be such as to include a link mechanism or a gear mechanism and furthermore, the control member 70 may be such as to include no controlling biasing member 72.

While the internal combustion engine is such as to be used on a vehicle in the embodiment, the invention can be applied to a marine propelling system such as a marine outboard engine in which a crankshaft is provided in such a manner as to be directed to the vertical direction. The internal combustion engine may be a multi-cylinder internal combustion engine other than the four-cylinder internal combustion engine or a single-cylinder internal combustion engine.

While the invention has been described in connection with the exemplary embodiments, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A variable valve system for an internal combustion engine, comprising:

a valve cam which actuates an engine valve of the internal combustion engine;

a transmission mechanism which transmits a valve actuating force of the valve cam to the engine valve and changes a maximum lift amount of the engine valve by being driven by a control member; and a biasing member which generates a biasing force which brings the transmission mechanism into contact with the valve cam, wherein the transmission mechanism comprises:

a holder actuated by the control member; and a rocker member oscillatably supported on the holder and disposed in an accommodating space defined by a frame-shaped member of said holder, wherein the rocker member comprises:

a cam contact portion which contacts with the valve cam at a cam contact point;

an output portion which outputs the actuating force which is inputted from the valve cam into the cam contact portion, to the engine valve; and an acting portion which contacts with the biasing member at a biased contact portion, and wherein the acting portion is provided in the vicinity of the cam contact portion in such a manner that:

the biased contact point is situated closer to the cam contact point than a rocking center line of the rocker member, and an acting line of the biasing force is superposed on the cam contact portion as viewed from a direction of the rocking center line.

2. The variable valve system as set forth in claim 1, wherein the cam contact portion is a roller which is provided on a support shaft which is provided on an arm portion of the rocker member, and wherein the acting portion is a cylindrical shaft end portion of the support shaft which protrudes to an opposite end to the roller across the arm portion.

3. The variable valve system as set forth in claim 1, wherein the cam contact portion is a roller which is provided on a support shaft which is provided rotatably on an arm portion of the rocker member, wherein the acting portion is a protruding portion which protrudes from the shaft portion at an opposite end to the roller across the arm portion, and wherein the protruding portion forms an oil reservoir portion for reserving lubricating oil for supply to a sliding portion between the arm portion and the support shaft.

4. The variable valve system as set forth in claim 3, wherein an axial movement of the support shaft is restricted by a snap ring which is mounted in a mount groove in the arm portion, and wherein the protruding portion is molded integrally with the arm portion where the mount groove is provided.

5. The variable valve system as set forth in claim 1, wherein the transmission mechanism further comprises:

a rocker arm which pressurizes the engine valve, said rocker arm being driven by the rocker member and being oscillatably supported on the holder, wherein the rocker member further comprises:

a fulcrum portion which is oscillatably provided on the holder; and a drive cam portion which contacts the rocker arm, wherein the holder comprises:

a pair of arm portions which support the rocker member and which are spaced apart in a direction of an oscillation center line of the rocker member; and a connecting portion which connects together the pair of arm portions, and wherein the biasing member is disposed on both sides of the cam contact portion in the direction of the oscillation center line and is held on to the connecting portion.

6. The variable valve system as set forth in claim 5, wherein the biasing member is disposed in a position where the biasing member is superposed on the drive cam portion in a direction of the acting line of the biasing force.

7. The variable valve system as set forth in claim 6, wherein the rocker arm comprises:

a hydraulic clearance adjusting member for adjusting a valve clearance of the engine valve; and an accommodating portion which accommodates therein the hydraulic clearance adjusting member and which defines an oil chamber in cooperation with the hydraulic clearance adjusting member and wherein an air vent hole for discharging air within the oil chamber is provided in the accommodating portion in such a manner as to be directed towards the biasing member.

8. The variable valve system as set forth in claim 7, wherein the rocker arm comprises a fulcrum portion which is oscillatably supported on the holder, wherein a straight-line oil passage extending towards the fulcrum portion is provided in the rocker arm, said rocker arm having an injection opening in an end portion thereof from which lubricating oil can be injected towards the biasing member, and wherein the biasing member is disposed on an extension of the straight-line oil passage.

9. The variable valve system as set forth in claim 6, wherein the rocker arm comprises a fulcrum portion which is oscillatably supported on the holder, wherein a straight-line oil passage extending towards the fulcrum portion is provided in the rocker arm, said rocker arm having an injection opening in an end portion thereof from which lubricating oil can be injected towards the biasing member, and wherein the biasing member is disposed on an extension of the straight-line oil passage.

10. The variable valve system as set forth in claim 5, wherein the rocker arm comprises:

a hydraulic clearance adjusting member for adjusting a valve clearance of the engine valve; and an accommodating portion which accommodates therein the clearance adjusting member and which defines an oil chamber in cooperation with the clearance adjusting member, and wherein an air vent hole for discharging air within the oil chamber is provided in the accommodating portion in such a manner as to be directed towards the biasing member.

11. The variable valve system as set forth in claim 10, wherein the rocker arm comprises a fulcrum portion which is oscillatably supported on the holder, wherein a straight-line oil passage extending towards the fulcrum portion is provided in the rocker arm, said rocker arm having an injection opening in an end portion thereof from which lubricating oil can be injected towards the biasing member, and wherein the biasing member is disposed on an extension of the straight-line oil passage.

12. The variable valve system as set forth in claim 5, wherein the rocker arm comprises a fulcrum portion which is oscillatably supported on the holder, wherein a straight-line oil passage extending towards the fulcrum portion is provided in the rocker arm, said rocker arm having an injection opening in an end portion thereof from which lubricating oil can be injected towards the biasing member, and wherein the biasing member is disposed on an extension of the straight-line oil passage.

13. The variable valve system as set forth in claim 5, wherein the cam contact portion is a roller which is provided on a support shaft which is provided on an arm portion of the rocker member, and wherein the acting portion is a cylindrical shaft end portion of the support shaft which protrudes to an opposite end to the roller across the arm portion.

14. The variable valve system as set forth in claim 1, wherein the transmission mechanism further comprises:

a rocker arm which pressurizes the engine valve and which is driven by the rocker member, wherein the holder is supported on an engine main body in such a manner as to be displaced about a displacement center line and oscillatably support the rocker member and the rocker arm, wherein the rocker arm is oscillatably supported on an arm portion of the holder, and wherein a distance between an acting point of a control force which is applied to the holder by the control member and an oscillation center line of the rocker arm is made shorter than a distance between the displacement center line and the oscillation center line.

15. The variable valve system as set forth in claim 14, wherein the control member comprises:

a control shaft which contacts a first contact portion of the holder so as to apply a driving force thereto; and a controlling biasing member which contacts a second contact portion of the holder and which produces a controlling biasing force for biasing the first contact portion relative to the control shaft, and wherein the controlling biasing member contacts the second contact portion in the vicinity of the oscillation center line.

16. The variable valve system as set forth in claim 15, wherein the support portion is a support shaft provided on the holder, and wherein the first contact portion is a roller which is rotatably supported on the support shaft.

17. The variable valve system as set forth in claim 16, wherein the rocker arm comprises:

a plurality of valve pressurizing portions which pressurize a plurality of engine valves; and a pair of fulcrum portions which define an accommodation space which accommodates therein the first contact portion, said pair of fulcrum portions being disposed on both sides of the roller with the roller held therebetween in a direction in which the plurality of valve pressurizing portions are aligned.

18. The variable valve system as set forth in claim 15, wherein a drive cam of the control shaft which contacts the first contact portion, the controlling biasing member and the first contact portion are disposed in positions which intersect a plane which is parallel to a cylinder axis of the internal combustion engine and a rotational center line of the valve cam.

19. The variable valve system as set forth in claim 14, wherein the cam contact portion is a roller which is provided on a support shaft which is provided on an arm portion of the rocker member, and wherein the acting portion is a cylindrical shaft end portion of the support shaft which protrudes to an opposite end to the roller across the arm portion.

20. The variable valve system as set forth in claim 1, wherein the transmission mechanism comprises:

the rocker member which contacts the valve cam;

a rocker arm which pressurizes the engine valve and which is driven by the rocker member; and the holder which is supported on an engine main body in such a manner as to be displaced about a displacement center line and oscillatably support the rocker member and the rocker arm, wherein the rocker arm is oscillatably supported on a support portion of the holder, and wherein an acting line of a control force applied to the holder by the control member is superposed on the support portion as viewed from a direction of an oscillation center line of the rocker arm.

21. The variable valve system as set forth in claim 20, wherein the control member comprises:

a control shaft which contacts a first contact portion of the holder so as to apply a driving force thereto; and a controlling biasing member which contacts a second contact portion of the holder and which produces a controlling biasing force for biasing the first contact portion relative to the control shaft, and wherein the controlling biasing member contacts the second contact portion in the vicinity of the oscillation center line.

22. The variable valve system as set forth in claim 21, wherein the support portion is a support shaft provided on the holder, and wherein the first contact portion is a roller which is rotatably supported on the support shaft.

23. The variable valve system as set forth in claim 21, wherein a drive cam of the control shaft which contacts the first contact portion, the controlling biasing member and the first contact portion are disposed in positions which intersect a plane which is parallel to a cylinder axis of the internal combustion engine and a rotational center line of the valve cam.

24. The variable valve system as set forth in claim 20, wherein the holder comprises a pair of arm portions on which the support portion is provided, and wherein in the vicinity of the support portion, the controlling biasing member contacts a connecting portion which connects said pair of arm portions together.

25. The variable valve system as set forth in claim 20, wherein the cam contact portion is a roller which is provided on a support shaft which is provided on an arm portion of the rocker member, and wherein the acting portion is a cylindrical shaft end portion of the support shaft which protrudes to an opposite end to the roller across the arm portion.

* * * * *